US005473338A

United States Patent [19]

Prince et al.

[11] Patent Number: 5,473,338

[45] Date of Patent: Dec. 5, 1995

[54] ADDRESSING METHOD AND SYSTEM HAVING MINIMAL CROSSTALK EFFECTS

[75] Inventors: Dennis W. Prince, Banks, Oreg.; John K. Grosspietsch, Vernon Hills, Ill.; Benjamin R. Clifton, Oregon City; Terry J. Scheffer, Portland, both of Oreg.

[73] Assignees: In Focus Systems, Inc., Wilsonville, Oreg.; a part interest; Motorola, Inc., Schaumburg, Ill.; a part interest

[21] Appl. No.: 77,859

[22] Filed: Jun. 16, 1993

[51] Int. Cl.[6] ..... G09G 3/36

[52] U.S. Cl. ..... 345/58; 345/94; 345/204

[58] Field of Search ..... 345/58, 84, 94, 345/95, 96, 99, 100, 136, 137, 204, 208, 209, 211, 93, 98

[56] References Cited

U.S. PATENT DOCUMENTS

| | | | |
|---|---|---|---|
| 3,955,187 | 5/1976 | Bigelow | 340/324 M |
| 4,413,256 | 11/1983 | Yasuda et al. | 345/209 |
| 4,485,380 | 11/1984 | Soneda et al. | 340/784 |
| 4,486,785 | 12/1984 | Lasher et al. | 345/136 |
| 4,645,303 | 2/1987 | Sekiya et al. | 345/208 |
| 4,746,197 | 5/1988 | Endo et al. | 350/333 |
| 4,845,482 | 7/1989 | Howard et al. | 340/805 |
| 4,892,389 | 1/1990 | Kuijk | 350/333 |
| 4,893,175 | 1/1990 | Fukada | 358/12 |
| 4,945,352 | 7/1990 | Ejiri | 340/805 |
| 5,119,084 | 6/1992 | Kawamura et al. | 345/98 |
| 5,130,703 | 7/1992 | Fairbanks et al. | 345/211 |
| 5,214,417 | 5/1993 | Yamazaki | 340/784 |
| 5,262,881 | 11/1993 | Kuwata et al. | 345/93 |
| 5,287,092 | 2/1994 | Shiraishi | 345/137 |
| 5,298,914 | 3/1994 | Yamazaki | 345/103 |
| 5,301,047 | 4/1994 | Hoshino et al. | 359/55 |
| 5,315,315 | 5/1994 | Nakamura | 345/208 |

FOREIGN PATENT DOCUMENTS

| | | | |
|---|---|---|---|
| 374845 | 6/1990 | European Pat. Off. . | |
| 0504816 | 3/1992 | European Pat. Off. | G09G 3/36 |
| 500354 | 8/1992 | European Pat. Off. . | |
| 0595495 | 5/1994 | European Pat. Off. | G09G 3/36 |
| 54-22856 | 5/1976 | Japan . | |

OTHER PUBLICATIONS

Ruckmongathan, "A Generalized Addressing Technique For RMS Responding Matrix LCDs", 1988 International Display Research Conference, pp. 80–85, 1988.

T. J. Scheffer et al. "Active Addressing of STN Displays for High Performance Video Applications," Displays, vol. 14, No. 2, Apr. 1993, Oxford (UK) pp. 74–85.

Celi et al., "A video controller for a liquid crystal alphanu (List continued on next page.)

*Primary Examiner*—Richard H. Hjerpe
*Assistant Examiner*—Steven J. Saras
*Attorney, Agent, or Firm*—Stoel Rives Boley Jones & Grey

[57] ABSTRACT

The optical response of the pixels of many flat panel display devices, such as liquid crystal displays (2), depends upon the spectral components, as well as the rms value, of the pixel voltage waveform during a frame period. Because each row and column electrode (10 and 11) addresses multiple pixels (14), the spectral voltage components of the voltage across any pixel during a frame period will depend upon the optical state of other pixels in the same column (11). This crosstalk phenomena can be greatly reduced by modifying the addressing signals. One method of modifying the addressing signals is to modulate them so that the spectral components of all pixel voltage waveforms fall primarily in a frequency band (54) in which the optical response is nearly independent of the frequency. Another method is to analyze (220) the spectral components of the pixel voltage waveform over a frame period before it is displayed and adjust (222) the amplitude of the addressing signals to compensate for the frequency dependence of the optical response. When using a gray scale addressing method involving an adjustment factor, such as one based upon virtual pixels (266), the value of each virtual information element (270) is multiplied by a correction factor to compensate for the different frequency components associated with the virtual row.

25 Claims, 27 Drawing Sheets

OTHER PUBLICATIONS meric panel," *Alta Frequenza,* vol. LI, No. 3 (May.—Jun. 1982), pp. 152–158.

W. E. Howard et al., "Eliminating Crosstalk in Thin Film Transistor/Liquid Crystal Displays," Conference Record of the 1988 International Display Research Conference, pp. 230–235.

M. J. Powell et al., "A 6–in. Full–Color Liquid–Crystal Television Using An Active Matrix of Amorphous–Silicon TFTs," Proceedings of the SID, vol. 29/3 1988, pp. 227–232.

J. R. Hughes, "Contrast Variations in High–Level Multiplexed Twisted Nematic Liquid–Crystal Displays," IEEE Proceedings, vol. 133, Pt. I, No. 4, Aug. 1986, pp. 145–151.

M. Akatsuka et al., "Material Approach for the Reduction of Crosstalk In Simple Matrix LCDs," IEEE Aug. 1991, pp. 64–67.

Y. Kaneko et al., "Crosstalk–Free Driving Methods for STN–LCDs," Proceedings of the SID, vol. 31/4 1990, pp. 333–336.

H. Hirai et al., "A New Driving Method for Crosstalk Compensation in Simple–Matrix LCDs," Japan Display '92, pp. 499–502.

S. Nishitani, et al., "New Drive Method to Eliminate Crosstalk in STN–LCDs" SID 93 Digest, pp. 97–100.

1.0
0.8
0.6
0.4
0.2
0.0
RELATIVE BRIGHTNESS
50
48
LOW FREQUENCY BAND 52
MIDDLE FREQUENCY BAND 54
HIGH FREQUENCY BAND 56
100Hz
1 kHz
10 kHz
100 kHz
FREQUENCY 18
18
11
3
18
11
18
11
14
16
10
14
10
12
16
14
14
14
14
10
16
14
14
16
2
14
10
3
14
16
10
12
14
3

ALT AND PLESHKO, ALTERNATING PIXEL STATES

ALT AND PLESHKO, ALTERNATING PIXEL STATES

ALT AND PLESHKO, RANDOM PIXEL STATES, MODIFIED ADDRESSING SIGNALS

ALT AND PLESHKO, RANDOM PIXEL STATES, MODIFIED ADDRESSING SIGNALS

ALT AND PLESHKO, PIXELS OFF, MODIFIED ADDRESSING SIGNALS

ALT AND PLESHKO, PIXELS OFF, MODIFIED ADDRESSING SIGNALS

ALT AND PLESHKO, ALTERNATING PIXEL STATES, MODIFIED ADDRESSING SIGNALS

ALT AND PLESHKO, ALTERNATING PIXEL STATES, MODIFIED ADDRESSING SIGNALS

ACTIVE ADDRESSING, ROW 16
106
152
RELATIVE MAGNITUDE
1.0
0.8
0.6
0.4
0.2
0.0
100Hz
1 kHz
10 kHz
100 kHz
FREQUENCY

ACTIVE ADDRESSING, ROW 16
106
154
RELATIVE MAGNITUDE
1.0
0.8
0.6
0.4
0.2
0.0
100Hz
1 kHz
10 kHz
100 kHz
FREQUENCY

ACTIVE ADDRESSING, ROW 16
106
156
RELATIVE MAGNITUDE
1.0
0.8
0.6
0.4
0.2
0.0
100Hz
1 kHz
10 kHz
100 kHz
FREQUENCY

ACTIVE ADDRESSING, ROW 16
106
158
RELATIVE MAGNITUDE
1.0
0.8
0.6
0.4
0.2
0.0
100Hz
1 kHz
10 kHz
100 kHz
FREQUENCY

ACTIVE ADDRESSING, ROW 232

106
178
RELATIVE MAGNITUDE
1.0
0.8
0.6
0.4
0.2
0.0
100Hz
1 kHz
10 kHz
100 kHz
FREQUENCY

ACTIVE ADDRESSING, ROW 232

106
180
RELATIVE MAGNITUDE
1.0
0.8
0.6
0.4
0.2
0.0
100Hz
1 kHz
10 kHz
100 kHz
FREQUENCY

ACTIVE ADDRESSING, ROW 232

106
182
RELATIVE MAGNITUDE
1.0
0.8
0.6
0.4
0.2
0.0
100Hz
1 kHz
10 kHz
100 kHz
FREQUENCY

ACTIVE ADDRESSING, ROW 232

106
184
RELATIVE MAGNITUDE
1.0
0.8
0.6
0.4
0.2
0.0
100Hz
1 kHz
10 kHz
100 kHz
FREQUENCY

ACTIVE ADDRESSING, ROW 16,
MODIFIED ADRESSING SIGNALS

RELATIVE MAGNITUDE
1.0
0.8
0.6
0.4
0.2
0.0
178
100Hz
1 kHz
10 kHz
100 kHz
FREQUENCY

ACTIVE ADDRESSING, ROW 16,
MODIFIED ADRESSING SIGNALS

RELATIVE MAGNITUDE
1.0
0.8
0.6
0.4
0.2
0.0
180
100Hz
1 kHz
10 kHz
100 kHz
FREQUENCY

ACTIVE ADDRESSING, ROW 16,
MODIFIED ADRESSING SIGNALS

RELATIVE MAGNITUDE
1.0
0.8
0.6
0.4
0.2
0.0
182
100Hz
1 kHz
10 kHz
100 kHz
FREQUENCY

ACTIVE ADDRESSING, ROW 16,
MODIFIED ADRESSING SIGNALS

RELATIVE MAGNITUDE
1.0
0.8
0.6
0.4
0.2
0.0
184
100Hz
1 kHz
10 kHz
100 kHz
FREQUENCY

ACTIVE ADDRESSING,
ROW 232, MODIFIED
ADRESSING SIGNALS 106
192
RELATIVE MAGNITUDE
1.0
0.8
0.6
0.4
0.2
0.0
100Hz
1 kHz
10 kHz
100 kHz
FREQUENCY

ACTIVE ADDRESSING,
ROW 232, MODIFIED
ADRESSING SIGNALS 106
194
RELATIVE MAGNITUDE
1.0
0.8
0.6
0.4
0.2
0.0
100Hz
1 kHz
10 kHz
100 kHz
FREQUENCY

ACTIVE ADDRESSING,
ROW 232, MODIFIED
ADRESSING SIGNALS 106
196
RELATIVE MAGNITUDE
1.0
0.8
0.6
0.4
0.2
0.0
100Hz
1 kHz
10 kHz
100 kHz
FREQUENCY

ACTIVE ADDRESSING,
ROW 232, MODIFIED
ADRESSING SIGNALS 106
198
RELATIVE MAGNITUDE
1.0
0.8
0.6
0.4
0.2
0.0
100Hz
1 kHz
10 kHz
100 kHz
FREQUENCY

ADDRESSING METHOD AND SYSTEM HAVING MINIMAL CROSSTALK EFFECTS

TECHNICAL FIELD

The present invention relates to a method and system for addressing rms-responding displays and, in particular, to a method and system for reducing crosstalk in high information content, passive matrix liquid crystal displays.

BACKGROUND OF THE INVENTION

Images are formed on flat panel displays, such as those used in televisions or notebook computers, by electrically controlling the optical properties of a large number of individual picture elements, or "pixels," made of an electro-optical material, such as a liquid crystal material. The large number of pixels allows the formation of arbitrary information patterns in the form of text or graphic images. The optical state of each pixel, which depends upon the voltage present across it, is controlled by applying electrical signals to addressing electrodes. The number of electrodes necessary to address the large number of pixels is greatly reduced by having each electrode address multiple pixels. In one common embodiment, transparent electrodes are positioned on opposing inner surfaces of parallel, transparent plates. A matrix of pixels is typically formed by electrodes arranged in horizontal rows on one plate and vertical columns on the other plate to provide a pixel wherever a row and column electrode overlap. Addressing signals determined by the image to be displayed are placed onto the electrodes by addressing signal voltage drives. A typical liquid crystal display may have 480 rows and 640 columns that intersect to form a matrix of 307,200 pixels. It is expected that matrix liquid crystal displays may soon comprise several million pixels. Because different pixels are addressed by the same electrodes, the optical states of individual pixels can be incidentally affected by the optical states of other pixels addressed by the same electrode.

The voltages of the addressing signals applied across the column electrode ("column signals") are typically dependent upon the image to be displayed, whereas the voltages of the addressing signals applied across the row electrodes ("row signals") are typically image independent. For example, in the Alt and Pleshko matrix addressing system described in "Scanning Limitations of Liquid Crystal Displays," IEEE Trans., ED21, pp. 146–55 (1974), each image-independent row signal effectively consists of a single rectangular pulse, the rectangular pulses being applied sequentially to each of the row electrodes. Every row is pulsed or "selected" during an addressing interval, once in each frame period. Typically there are as many addressing intervals as there are display rows.

Another technique for matrix addressing, known as "Active Addressing™," is described in co-pending U.S. patent application Ser. No. 07/678,736 of Scheffer et al. for "LCD Addressing System." In the Active Addressing™ technique, the row signals comprise more than one selection pulse, the multiple selection pulses being distributed over the frame period. These row signals are preferably a set of orthonormal functions, such as Walsh functions. The column signals during each addressing interval depend upon the desired image and the row signals. The frame period is divided into multiple addressing intervals, with multiple rows being selected during any addressing interval.

In a passive matrix-type display, neglecting electrode resistance, the voltage across a pixel at any time is the difference between the voltages on the row and column electrodes that define the pixel. The pixel voltage varies during a frame period. The pixel voltage over a frame period can be characterized by a pixel voltage waveform having a root-mean square ("rms") value. Addressing systems are directed toward controlling the rms voltage across a pixel.

The optical state of a pixel, i.e., whether it will appear dark, bright, or an intermediate gray shade, is determined by the orientation of the liquid crystal molecules associated with the pixel. For a supertwisted nematic device, the orientation of the liquid crystal molecules is altered by modifying a voltage applied across the pixel. The applied voltage produces on the liquid crystal molecule an electric torque that is proportional to the square of the voltage. The electric torque counters an elastic torque and a viscous torque, the magnitudes of which determine a characteristic response time for the pixel. Therefore, if the characteristic response time of the pixel is many times longer than the frame period, the optical state of a pixel will be determined primarily by the rms voltage across the pixel, averaged over the frame period. To change the optical state of a pixel, the rms voltage across that pixel must be appropriately changed.

In a typical matrix-type display, all of the pixels in a column share a common column electrode, so changing the rms voltage across one pixel might change the rms voltage across the other pixels in the column as well. However, by implementing an addressing technique known as "multiplexing" it is possible to change the rms voltages (within certain limits) of individual pixels in the column without affecting the rms voltages across the other pixels. By applying the multiplexing technique, the optical states of individual pixels in the column are changed by appropriately changing the addressing waveform applied to the column electrode. This change affects the pixel voltage waveform of all of the pixels in the column but does not necessarily change the rms voltage across those pixels because many different waveforms can have the same rms value averaged over a frame period. The art of multiplexing lies in generating and applying the appropriate waveforms to the columns such that predetermined rms voltages are produced across each pixel in the columns.

However, it is known that the optical response of a liquid crystal display to an applied electrical signal depends not only on the rms voltage value of the signal but also on the frequency of that signal if it is a sine wave and on the complete frequency spectrum of the signal if it is a more complex waveform. Thus, to precisely predict the optical response of a pixel to an applied signal, the amplitudes of each frequency component of the signal must be known in addition to the rms value of the signal.

The pixel voltage waveform is determined primarily by the addressing signals applied to the row and column electrodes that overlap to define the pixel. The row and column signals can be separately analyzed into spectral voltage components, which contribute to the spectral makeup of the pixel voltage waveform. The column signals present on the column electrodes over a frame period depend upon the optical state of all pixels in the column. The optical state of each pixel depends, therefore, upon the optical states of all other pixels in the column.

In some displayed images, this interdependence results in a phenomena known as "ghosting," which is manifested by vertical trails above and below written characters on the display. Ghosting is especially noticeable when OFF pixels in one column have a slightly different optical state than adjacent OFF pixels in columns having different information patterns. This occurs because, although the rms voltage across all of the OFF pixels is the same, the spectral composition of each of the pixel voltage waveforms can be different, depending upon the displayed information of each column; some OFF pixels will have waveforms with lower or higher spectral voltage components than other OFF pixels, causing those pixels to have different optical states. We will refer to this type of crosstalk as "spectral crosstalk."

The dependence of the optical state of a pixel on the frequency of the spectral components of the pixel voltage is a consequence of both the device characteristics and the material constants of the display. The device characteristics can cause the actual pixel voltage, i.e., the potential difference across the electrodes at the pixel, to be different from the applied pixel voltage, i.e., the potential difference applied by the signal at the corresponding addressing electrodes. For example, the sheet resistance of the display electrodes and the capacitance of the liquid crystal layer are known to act together as a distributed low-pass filter. Thus, the high frequency components of the addressing signals are more attenuated than are the low frequency components, as shown by actual voltage measurements at the pixel site. This attenuation distorts the waveform appearing across the pixel from the waveforms placed onto the electrodes by the signal driver and decreases the actual rms pixel voltage. This attenuation is especially strong when a significant proportion of the frequency components of one or both of the addressing signals occur at higher frequencies. FIG. 1 is a graph showing the relative brightness of the optical state of a pixel versus frequency for a typical nematic liquid crystal display with sine-wave drive at constant rms voltage. The roll-off at high frequencies is primarily caused by this attenuation effect. The increase at low frequencies is believed to be caused by interfacial double layers, which are believed to be generated by ionic impurities.

The liquid crystal material constants also contribute to the frequency dependence of the optical state of the pixel. The effect of an applied electric field on the orientation of the liquid crystal molecules is determined in large part by the dielectric anisotropy, i.e., the difference between the dielectric constant of the liquid crystal measured parallel and perpendicular to the long axes of the molecules. The dielectric anisotropy is not a constant; it is a function of the frequency of the voltage across the liquid crystal. Therefore, the orientation of the liquid crystal and its associated optical state are also frequency dependent. Part of the roll-off at high frequencies shown in FIG. 1 is due to this effect. This frequency dependence also causes column ghosting as described above.

Addressing systems have been designed primarily to apply a desired rms voltage across a row and column electrode during a frame period. The frequency dependence of the optical state has been minimized primarily by attempts to modify the liquid crystal material constants and device parameters to weaken the dependence of the optical state on frequency. See, for example, Akatsuka et al., Material Approach for Reduction of Cross Talk in Simple Matrix LCDs," IEEE (1991). Akatsuka describes reducing the dependence of threshold voltage on frequency by increasing the resistivity of the liquid crystal material and of the alignment layer. Higher resistivity liquid crystal materials and alignment layers are, however, difficult to maintain in a display cell over long periods of time due to the slow contamination caused by impurities diffusing into the cell through the edge seal.

SUMMARY OF THE INVENTION

An object of the present invention is, therefore, to improve image quality in an rms-responding, passive matrix display by reducing image degrading crosstalk, i.e., incidental effects that the optical state of one pixel has on the optical states of other pixels in the display.

Column or row addressing signals are determined that compensate for these crosstalk effects by de-emphasizing the effects of spectral components that fall outside of a relatively constant, middle frequency band of the optical response curve shown in FIG. 1. These signals are then applied to the addressing electrodes.

The effect of spectral components that fall outside of the relatively constant, middle frequency band of the optical response curve can be de-emphasized in a nonadaptive or adaptive manner. A nonadaptive method is independent of the addressing signal waveforms during any particular frame period. A nonadaptive method typically de-emphasizes the frequency bands outside of the relatively constant, middle frequency band by modulating the addressing signals to reduce the components outside of the middle band. An adaptive method depends upon the addressing signal waveforms during a frame period. An adaptive method typically de-emphasizes the effect of spectral components outside of the middle band by decreasing the amplitude of components that fall in a low frequency, high optical response band or by increasing the amplitude of components that fall in a high frequency, lower optical response band. The amplitude of the spectral components can be increased or decreased by changing the amplitude of spectral components in a particular frequency band or by adjusting the amplitudes of the addressing signals to change the amplitude of all spectral components.

In Alt and Pleshko addressing, the row signals for each row are similar, phase-shifted versions of each other and, therefore, have identical frequency spectra. Therefore, differences between pixel voltage waveforms result primarily from differences in column signals caused by different images being displayed. In the Active Addressing™ technique, however, the rows generally have different row signals. For example, the Active Addressing™ technique can use a set of addressing functions, such as Walsh functions, having different sequencies, i.e., different numbers of transitions per frame period, and, therefore, different spectral voltage components. Pixels in rows addressed by low sequency Walsh functions will have pixel voltage waveforms having spectral voltage components at lower frequencies and will appear brighter than rows addressed by high sequency functions. This can introduce an objectionable gradient of the optical transmission along the column axis of the display.

Determining and applying addressing signals in accordance with the present invention corrects both column ghosting and undesired optical transmission gradients. The nonadaptive method typically entails first a determination of addressing signal waveforms that provide a pixel voltage having a pre-determined rms value corresponding to the rms value that would produce the desired optical state if the optical response were not frequency dependent. The addressing signal waveforms are then modified to produce addressing signals such that the majority of spectral components of the pixel voltage waveforms appear within a frequency band in which the optical response of the display is relatively independent of frequency.

One method of modifying the addressing signals is to modulate them in a manner that maintains the predetermined rms values of the pixel voltages during a frame period but increases the frequency of their components. In a preferred embodiment, the row and column signals are modulated by a Manchester pulse using circuitry that reverses the polarity of the row and column signals for part of an addressing interval. Many other modulation schemes can be used to carry out the invention.

Another method of determining addressing signals entails the use of a virtual pixel information element correction factor to reduce crosstalk in gray level addressing schemes. Displays using the gray scale method described in copending U.S. patent application Ser. No. 07/883,002 of Scheffer et al. for "Gray Level Addressing for LCDs" produce an accurate rms value at each pixel by defining virtual pixels. Virtual pixels are defined by the intersection of the column electrodes with a virtual row electrode and each virtual pixel has an associated virtual information elements. The values of the virtual information elements are used in computing the column signals. However, frequency components of a virtual addressing signal that addresses the virtual row have an effect on the brightness of columns that include pixels having intermediate gray levels. For example, if the virtual row addressing signal has a preponderance of low frequency components, a column that includes pixels having intermediate gray levels will be incidentally brightened. Applying a correction factor to the calculated value of the virtual information element compensates for this effect by adjusting the amplitude of frequency components that lie outside of the constant optical response frequency band.

Another adaptive method of modifying the column addressing signals typically entails determining the spectral components of the column voltage waveform and adjusting the amplitude of the column addressing signal to compensate for the sensitivity of the optical state transmission to those spectral components. For example, if the column voltage waveform is found to include significant spectral components at low frequencies, the amplitude of the row or column signal is reduced to compensate for the increased transmission of the optical state at low frequencies. To simplify the method, the frequency spectrum of the column voltage waveform can be sampled at a small number of frequencies rather than analyzing the entire spectrum. Adjusting the amplitude of the column addressing signals changes the amplitude of the frequency components in all frequency bands.

Row signals that de-emphasize the effects of frequency components falling outside of the relatively constant optical response frequency band can also be adaptively or non-adaptively determined. For example, in the Active Addressing™ technique using row functions derived from Walsh functions, the column gradient induced by different sequencies of Walsh row functions can be non-adaptively modified by applying the modulation schemes described above. Alternatively, row addressing signals can also be adaptively adjusted in amplitude to compensate for the variation in frequency components of the row signals used in the Active Addressing™ technique. Both row and column addressing signals, and any combination thereof, can be determined using an adaptive, non-adaptive method, or a combination of both methods to de-emphasize the effects of frequency components outside of the relatively constant optical response frequency band.

Additional objects and advantages of the present invention will be apparent from the following detailed description of preferred embodiments thereof, which proceeds with reference to the accompanying drawings.

BRIEF DESCRIPTION OF THE DRAWINGS

FIGS. 12*a*, 13*a*, and 14*a* are graphs showing the applied pixel voltage waveforms appearing during a frame period for a pixel in an ON optical state in a column having other pixels whose optical states are random, OFF, and alternating ON and OFF, respectively. FIGS. 12*b*, 13*b*, and 14*b* are frequency domain plots showing the spectral components of the applied pixel voltage waveforms shown in respective FIGS. 12*a*, 13*a*, and 14*a* superimposed on the optical response curve of FIG. 1.

FIG. 21*a* is a graph of the same part of a typical Active Addressing™ technique row signal as shown in FIG. 10*a*. FIG. 21*b* is a graph of a Manchester modulation signal having a period equal to the addressing interval. FIG. 21*c* is a graph of a second modulation signal having a period of three times the addressing interval. FIG. 21*d* is a graph showing a waveform of a new modulation signal that results from applying the modulation signal of FIG. 21*b* to the modulation signal of FIG. 21*c*. FIG. 21*e* is a graph showing a row signal that results from applying the modulation signal of FIG. 21*d* to the row addressing signal of FIG. 21*a*.

DETAILED DESCRIPTION OF PREFERRED EMBODIMENTS

Figure 2:
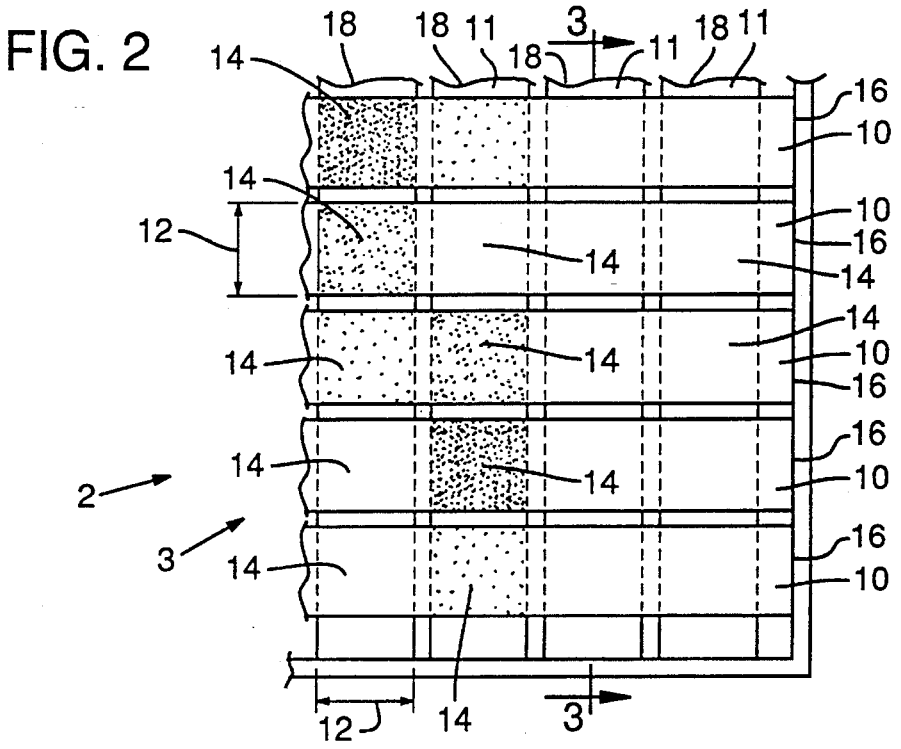
FIG. 2 is a diagrammatic, fragmentary plan view of a liquid crystal display in accordance with the present invention.
Figure 3:
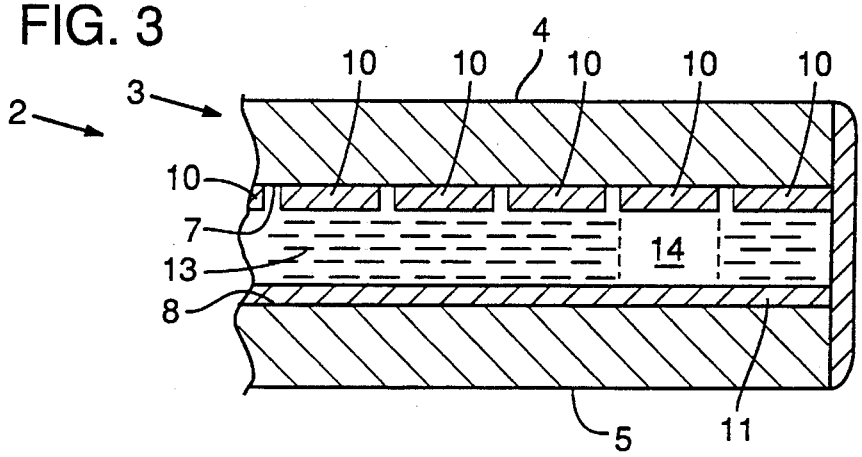
FIG. 3 is a sectional view taken along lines 3—3 of FIG. 2.

FIGS. 2 and 3 show part of a typical rms-responding display system 2 comprising a display 3 including two glass plates 4 and 5 having on their respective inner surfaces 7 and 8 respective first and second sets of electrodes 10 and 11. First and second sets of electrodes, 10 and 11, will be referred to as row electrodes 10 and column electrodes 11, although it is clear that this designation is arbitrary either set of electrodes could be arranged as rows or columns . Row electrodes 10 and column electrodes 11 are preferably perpendicular to each other and of equal width 12. An electro-optical material, such as a nematic liquid crystal 13 operated in a supertwist mode, is positioned between plates 4 and 5. The overlapping areas of row electrodes 10 and column electrodes 11 define a matrix of picture elements or pixels 14. Each row electrode 10 defines a row 16 of pixels 14, and each column electrode 11 defines a column 18 of pixels 14. Display system 2 includes a large number of such pixels 14, which together are capable of forming an arbitrary image.

The optical state of each pixel 14 is controlled by the voltage across it, the actual "pixel voltage," during each frame period. A pixel 14 is in an ON state when a sufficiently large voltage is applied. A pixel 14 is in an OFF state when voltage below a threshold voltage, typically about one to two volts, is applied. A pixel 14 is in an intermediate gray level when it is neither fully ON nor fully OFF. Although an ON pixel 14 may be either bright or dark depending on the display design, it will be assumed below for convenience that a pixel 14 is bright in the ON state. If the characteristic response time of display 3 is many times longer than the frame period or if and Active Addressing™ technique is used, the optical characteristics of pixel 14 during a frame period will depend on the rms voltage value across the pixel and on the spectral components of the voltage waveform across the pixel.

The pixel voltage at a pixel 14 is determined by the potential difference between the row electrode 10 and column electrode 11 at the overlapping area that defines the pixel 14. Drivers apply addressing signals to electrodes 10 and 11 in accordance with an addressing system during multiple addressing intervals that make up a frame period. In a typical addressing system, image-independent voltage waveforms are applied to row electrodes 10 and image-dependent waveforms are applied to column electrodes 11. Because the sheet resistance of electrodes 10 and 11 together with the capacitance of liquid crystal act as a low-pass filter, the potential difference between electrodes 10 and 11 at pixel 14, i.e., the actual pixel voltage, deviates from the difference in potentials applied to electrodes 10 and 11 by their respective drivers, i.e., the "applied pixel voltage." The deviation depends upon the spectral components of the addressing signals.

The applied and actual pixel voltage waveforms can be analyzed in the frequency domain by applying Fourier transform techniques. Because the optical response of liquid crystal 13 during a frame period depends not only on the rms value, but also on the frequency of the actual pixel voltage, pixels 14 having actual voltage waveforms with significant spectral components in low frequency bands appear with a different brightness than pixels 14 having an actual pixel voltage with the same rms value but having frequency components in a higher frequency band. Furthermore, because of the low-pass filter characteristics of display 3, the high frequency components of applied pixel waveforms are attenuated before arriving at pixel 14, resulting in a lower actual rms voltage value across pixel 14 for applied waveforms having significant high frequency components.

Figure 4:
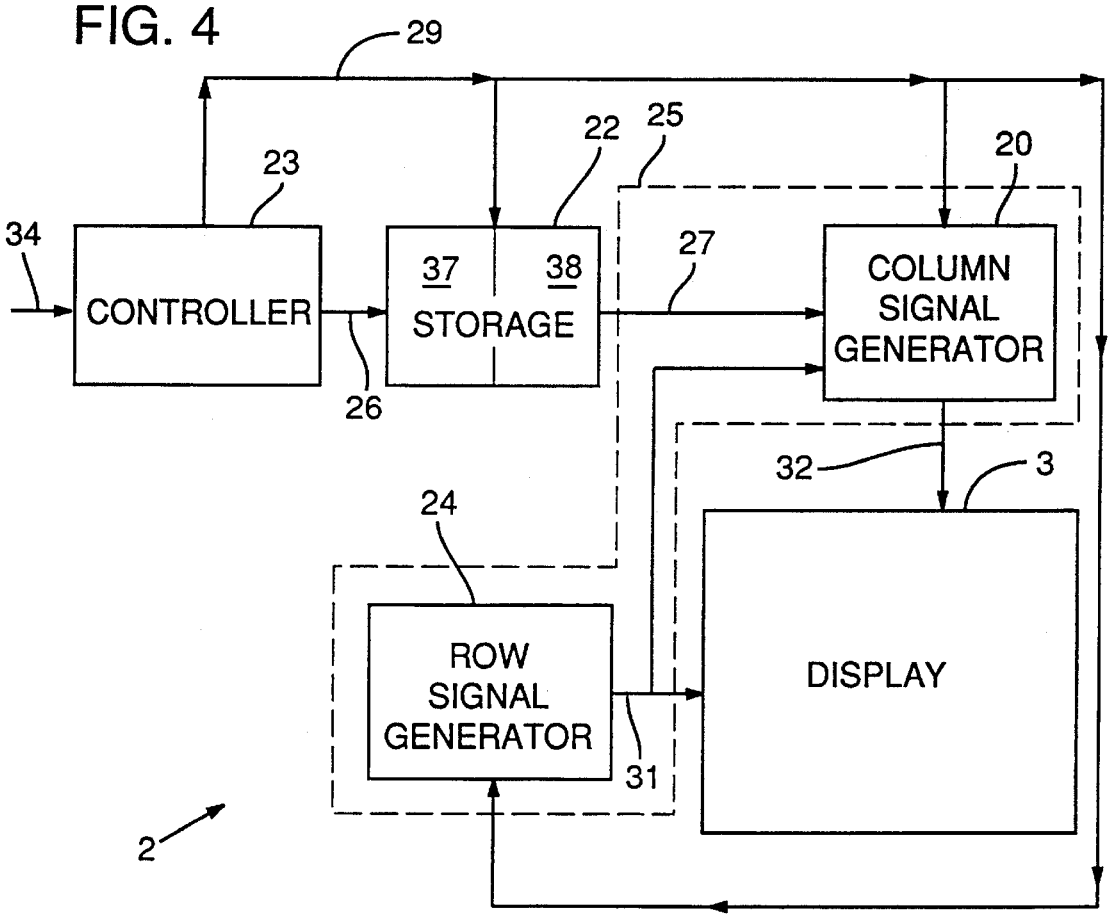
FIG. 4 is a block diagram of the apparatus of a typical actively addressed display system.
Figure 5:
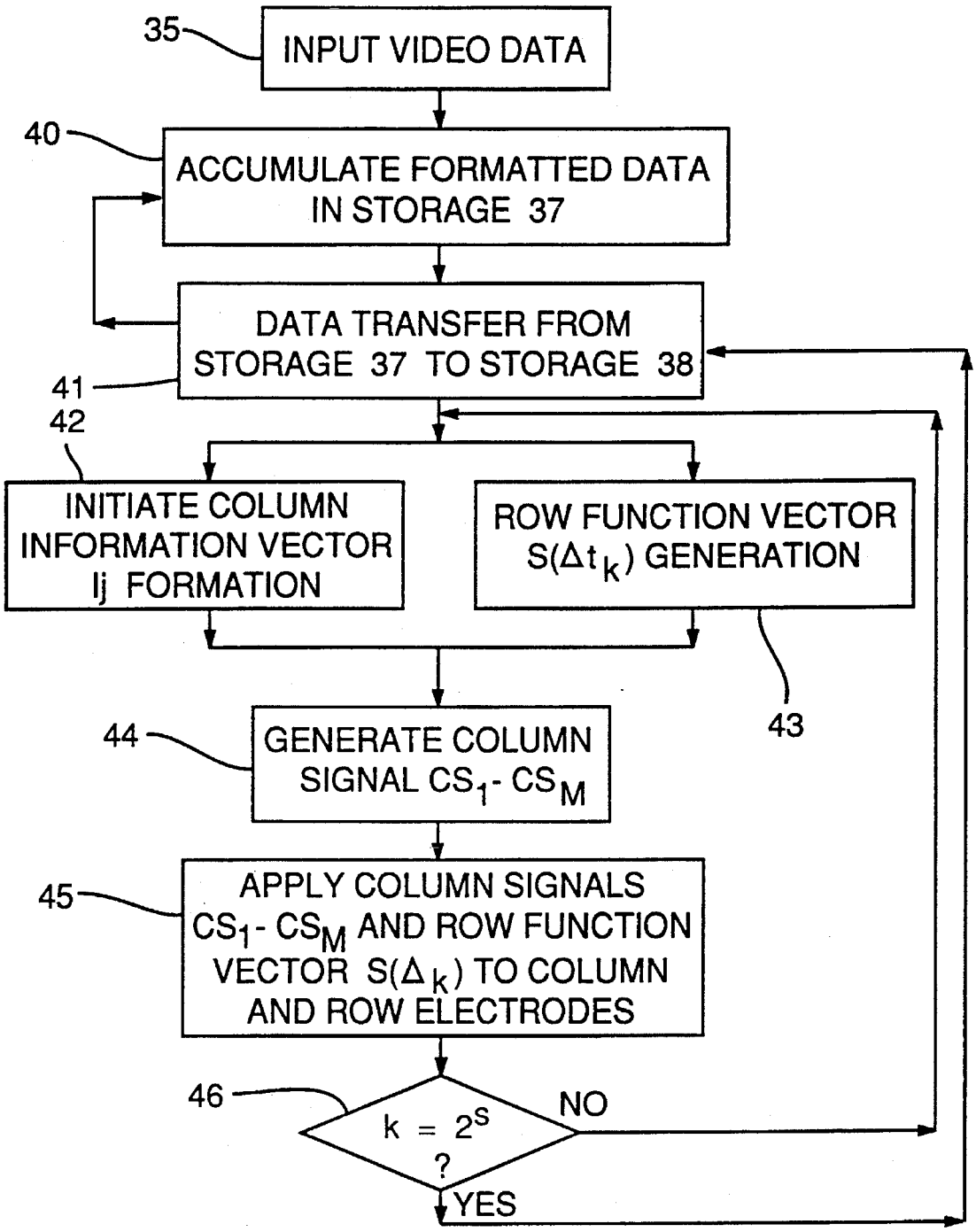
FIG. 5 is a flowchart of the basic operation of a typical actively addressed display system.

FIGS. 4 and 5 illustrate the components and operation of a typical actively addressed display system used in the preferred embodiment of the present invention. Referring to FIG. 4, display system 2 comprises display 3, a column signal generator 20, a storage means 22, a controller 23, and a row signal generator 24. Column signal generator 20 and row signal generator 24 comprise an addressing signal generator 25. A data bus 26 electrically connects controller 23 with storage means 22. Similarly, a second data bus 27 connects storage means 22 with column signal generator 20. Timing and control bus 29 connects controller 23 with storage means 22, column signal generator 20 and row signal generator 24. A bus 31 provides row signal information from row signal generator 24 to column signal generator 20. Bus 31 also electrically connects row signal generator 24 with display 3. Another bus 32 connects column signal generator 20 with display 3. Controller 23 receives video signals from an external source (not shown) via an external bus 34.

The video signals on bus 34 include both video display data and timing and control signals. The timing and control signals may include horizontal and vertical synchronization information. Upon receipt of video signals, controller 23 formats the display data and transmits the formatted data to storage means 22. Data is subsequently transmitted from storage means 22 to column signal generator 20 via bus 27.

Timing and control signals are exchanged between controller 23, storage means 22, row signal generator 24 and column signal generator 20 along bus 29.

Referring now to FIG. 5, the operation of display system 2 will be described in conjunction with the embodiment shown in FIG. 4. FIG. 5 depicts a flowchart summary of the operating sequence or steps performed by the embodiment of FIG. 4.

As indicated at step 35, video data, timing and control information are received from the external video source by controller 23. Controller 23 accumulates a block of video data, formats the display data and transmits the formatted display data to storage means 22.

Storage means 22 comprises a first storage circuit 37 for accumulating the formatted display data transferred from controller 23 and a second storage circuit 38 that stores the display data for later use.

In response to control signals provided by controller 23, storage means 22 accumulates or stores the formatted display data (step 40) in storage circuit 37. Accumulating step 40 continues until display data has been accumulated corresponding to the N rows by M columns of pixels, N and M being integers.

When an entire frame of display data has been accumulated, controller 23 generates a control signal that initiates transfer of data from storage circuit 37 to storage circuit 38 during transfer step 41.

At this point in the operation of display system 2, controller 23 initiates three operations that occur substantially in parallel. First, controller 23 begins accepting new video data (step 35) and accumulating a new frame of data (step 40) in storage circuit 37. Second, controller 23 initiates the process for converting the display data stored in storage circuit 38 into column signals $CS_1$-$CS_M$ corresponding to columns 1 to M and having amplitudes $G_{I1}$, $(\Delta t_k)$–$G_{IM}(\Delta t_k)$ beginning at step 42. Third, controller 23 instructs row signal generator 24 to supply a row function vector $S(\Delta t_k)$ having elements corresponding to the values of each of the row functions during time interval $\Delta t_k$ to column signal generator 20 and to display 3. The third operation is referred to as the row function vector generation step 43 during which a row function vector $S(\Delta t_k)$ is generated or otherwise selectively provided to column signal generator 20. Row function vector $S(\Delta t_k)$ is also provided to display 3. In some embodiments of the invention, row function vector $S(\Delta t_k)$ may be modified before being provided to display 3.

As described above, N row functions $S_i$ are provided by row signal generator 24, one row function for each row. The N row functions $S_i$ are periodic in time and the period is divided into R time intervals, $\Delta t_k$ (where k= 1 to R). Therefore, there are a total of N unique row functions $S_i$, one for each row 16 of display 3, with each divided into R time intervals $\Delta t_k$. For example, if a subset of N rows of a $2^S \times 2^S$ Walsh matrix were used as row functions $S_i$, the number of time intervals R would be at least $2^S$.

A row function vector $S(\Delta t_k)$ is comprised of all N row functions $S_i$ at a specific time interval $\Delta t_k$. Because there are at least R time intervals $\Delta t_k$, there are at least R row function vectors $S(\Delta t_k)$. Row function vectors $S(\Delta t_k)$ are applied to rows 16 of display 3 by row signal generator 24 so that each element $S_i$ of row function vector $S(\Delta t_k)$ is applied to the corresponding row $\mathbf{16}_i$ of display 3 at time interval $\Delta t_k$. Row function vectors $S(\Delta t_k)$ are also used by column signal generator 20 in generating column signals $CS_1$- $CS_M$ each having a corresponding amplitude $G_{I1}(\Delta t_k)$ through $G_{IM}(\Delta t_k)$.

Display data stored in storage circuit 38 are provided to the column signal generator 20 at step 42. In this manner, an information vector $I_j$ is provided to column signal generator 20 such that each element $I_{ij}$ of information vector $I_j$ represents the display state of a corresponding pixel in the $j^{th}$ column. An information vector $I_j$ is provided for each of the M columns of pixels of display 3.

During column signal generation step 44, each information vector $I_j$ is combined with the row function vector $S(\Delta t_k)$ to generate a column signal $CS_j$ for the $j^{th}$ column during the $k^{th}$ time interval. In a display 3 capable of displaying in multiple gray levels, each column may contain a virtual pixel having an associated virtual information element that is combined with a virtual row signal to contribute to column signal $CS_j$. Column signals $CS_1$-$CS_M$, each having amplitude $G_{Ij}$ $(\Delta t_k)$, are generated for each of the M columns 18 of display 3 for each time interval $\Delta t_k$. When the amplitude $G_{Ij}$ $(\Delta t_k)$ for all column signals $CS_1$-$CS_M$ is calculated for time interval $\Delta t_k$, all column signals $CS_1$-$CS_M$ are presented, in parallel, to column electrodes $\mathbf{11}_1$-$\mathbf{11}_M$ during time interval $\Delta t_k$ via bus 32. At the same time, the $k^{th}$ row function vector $S(\Delta t_k)$ is applied to row electrodes $\mathbf{10}_1$- $\mathbf{10}_N$ of display 3 via bus 31 as indicated by step 45. In some embodiments of the invention, column signals $CS_1$-$CS_M$, row function vector $S(\Delta t_k)$, or both are modified, as described below, before being applied to display 3.

After column signals $CS_1$-$CS_M$ have been presented, the k+1 row function vector $S(\Delta t_{k+1})$ is selected and steps 42–45 are repeated as indicated by the "no" branch of decision step 46. When all R row function vectors $S(\Delta t_k)$ have been combined with all information vectors $I_1$-$I_M$, the "yes" branch of decision step 46 instructs controller to return to step 41 and transfer the accumulated frame of information vectors $I_1$-$I_M$ to storage means 38 (step 41) and the entire process is repeated. In some embodiments of the invention, the column signals $CS_1$-$CS_M$ for all time intervals $\Delta t_1$-$\Delta t_R$ of the frame period are generated and analyzed before modified column signals are applied to column electrodes $\mathbf{11}_1$-$\mathbf{11}_M$.

Figure 1:
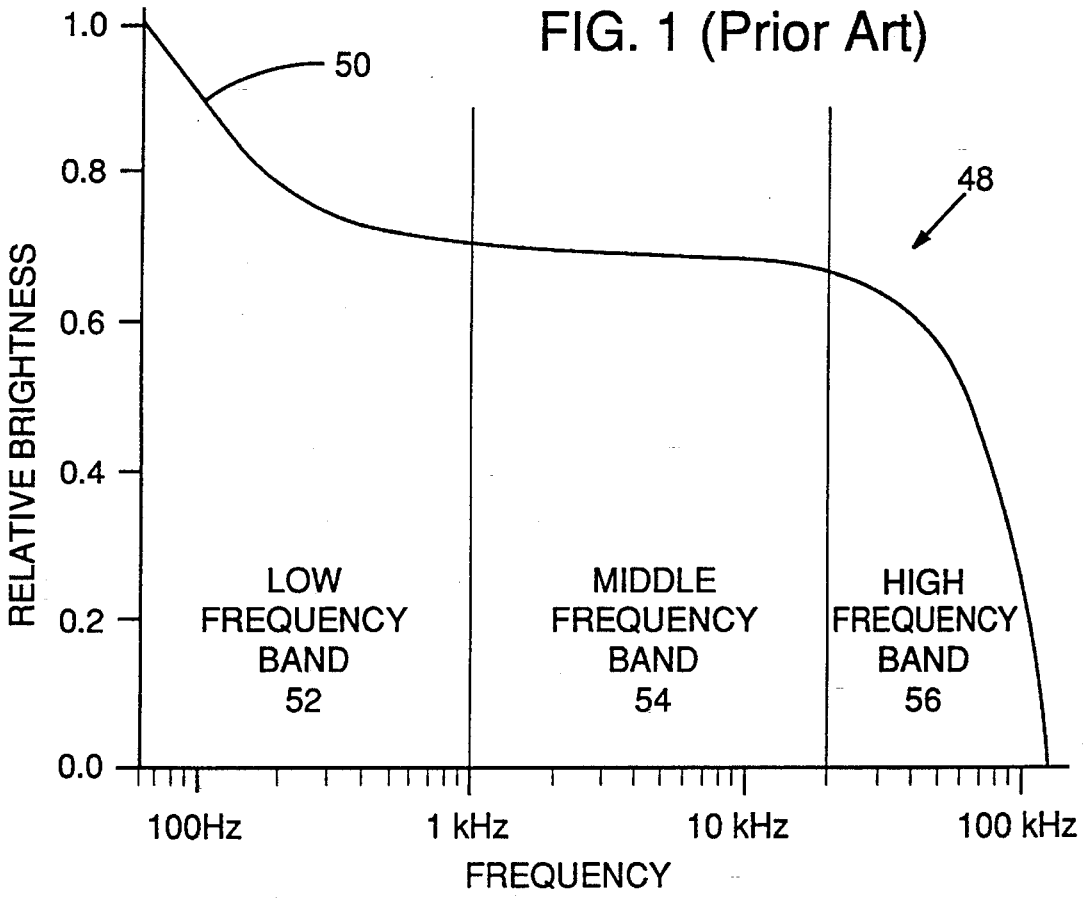
FIG. 1 (Prior Art)
FIG. 1 is a qualitative graph showing, for a typical nematic liquid crystal display, the relative brightness of the optical state of a pixel versus the frequency of an applied sine-wave drive at constant rms voltage.

FIG. 1 is a qualitative graph 48 showing, for a typical nematic liquid crystal display, the optical response or relative brightness 50 of the optical state of a pixel 14 versus frequency of an applied sine-wave drive at constant rms voltage. The frequency axis can be divided into three bands: a low frequency band 52 having above-average optical response; a middle frequency band 54 in which the optical response is relatively constant over a range of frequencies; and a high frequency band 56, in which the optical response diminishes rapidly as frequency increases. The optical response is relatively non-constant in frequency bands 52 and 56 compared to the relatively constant optical response in middle frequency band 54.

Figure 6:
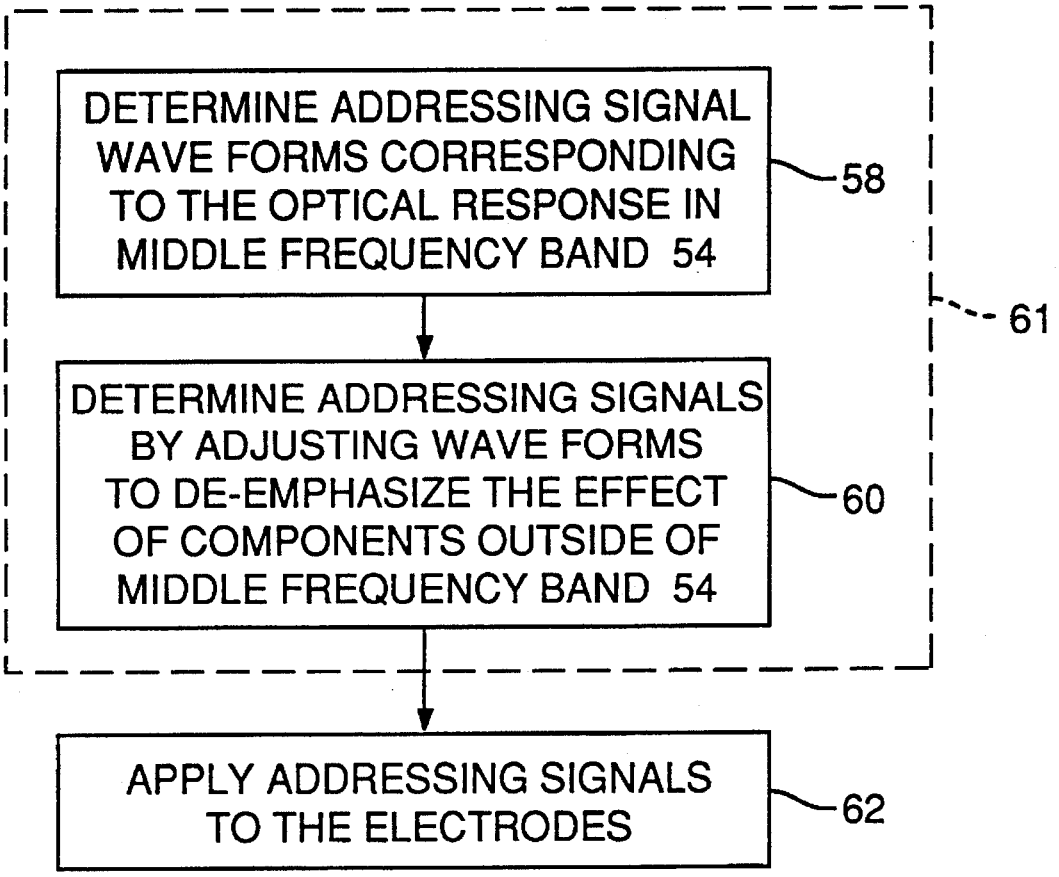
FIG. 6 is a flowchart showing steps of a typical embodiment of the method of the present invention.

The method of the invention entails determining addressing signals that select each row multiple times during a frame period and that provide the pixels with the desired optical state by de-emphasizing the effects of frequency components outside of the relatively constant optical response frequency band 54 and then applying the addressing signals to the first and second electrodes. FIG. 6 shows steps involved in a typical embodiment of the invention. Step 58 indicates that addressing signal waveforms are determined that produce across pixels 14 a predetermined rms voltage corresponding to a desired optical response. The rms voltage is determined by ignoring the frequency dependence of the optical response and assuming the optical response at all frequencies corresponds to the optical response in middle frequency band 54. Step 60 indicates that the addressing signal waveforms are then adjusted to de-emphasize the effect of components outside of middle frequency band 54. The result of steps 58 and 60 could also be obtained in one step 61 by directly determining addressing signal that de-emphasize the effect of components outside of middle frequency band 54. Step 62 indicates that the addressing signals are then applied to electrodes 10 and 11.

The "nonadaptive" embodiment of this invention typically entails determining addressing signals that produce pixel voltage waveforms comprising predominantly spectral components that fall within middle frequency band 54, regardless of the nature of the displayed image. In this embodiment, step 58 is typically performed as described above and step 60 typically entails modulating the addressing signals determined in step 58 to modify the spectral components of the applied pixel voltage waveform without changing the rms voltage value. The modulated signals are then applied to the appropriate addressing electrodes. The embodiment is nonadaptive in that the modulation does not depend on the particular addressing signals during the frame.

In an Alt and Pleshko-type addressing system, each row 16 is selected once per frame period by applying a nonzero row voltage to the corresponding row electrode 10 during an addressing interval; during the remaining addressing intervals of the frame period the row voltage is zero. During the addressing interval in which a row 16 is selected, column signals applied to each column electrode 11 determine whether each pixel 14 in the selected row 16 is ON or OFF.

Figure 7B:
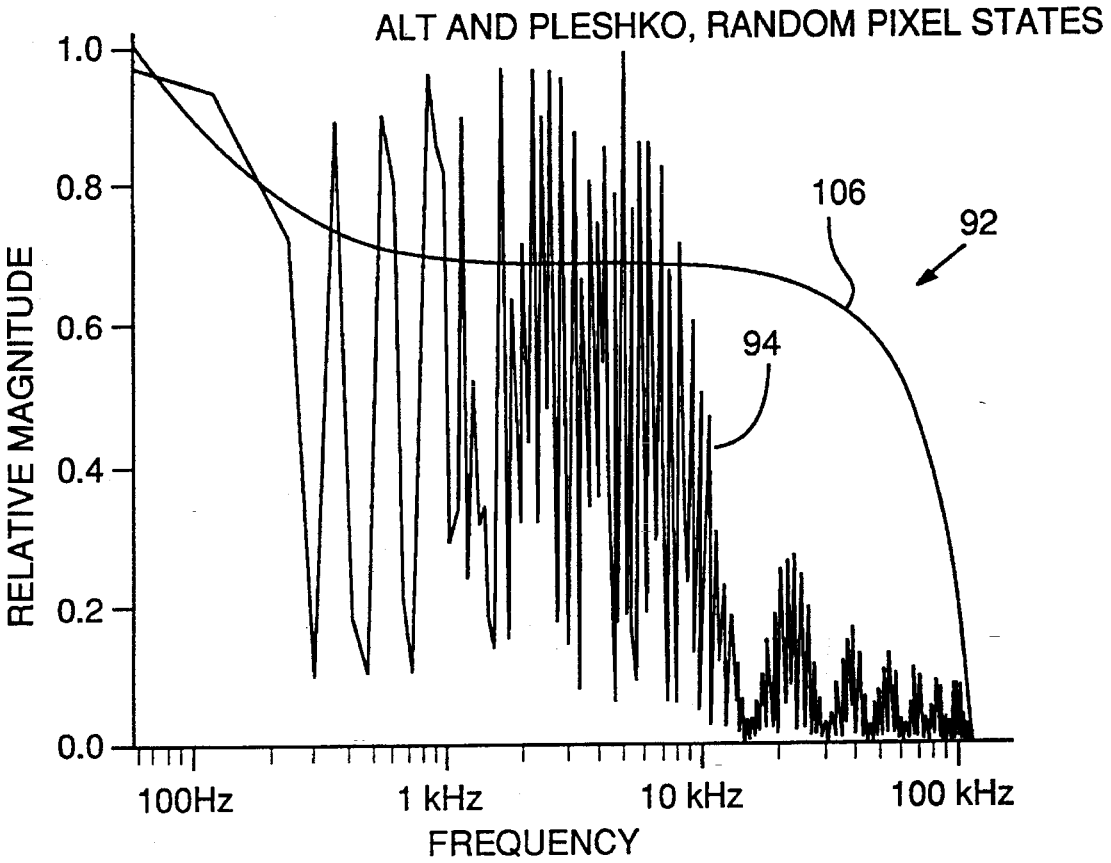
FIGS. 7*b*, 8*b*, and 9*b* are frequency domain plots showing the spectral components of the applied pixel voltage waveforms of respective FIGS. 7*a*, 8*a*, and 9*a*, superimposed on the optical response curve of FIG. 1.
Figure 7A:
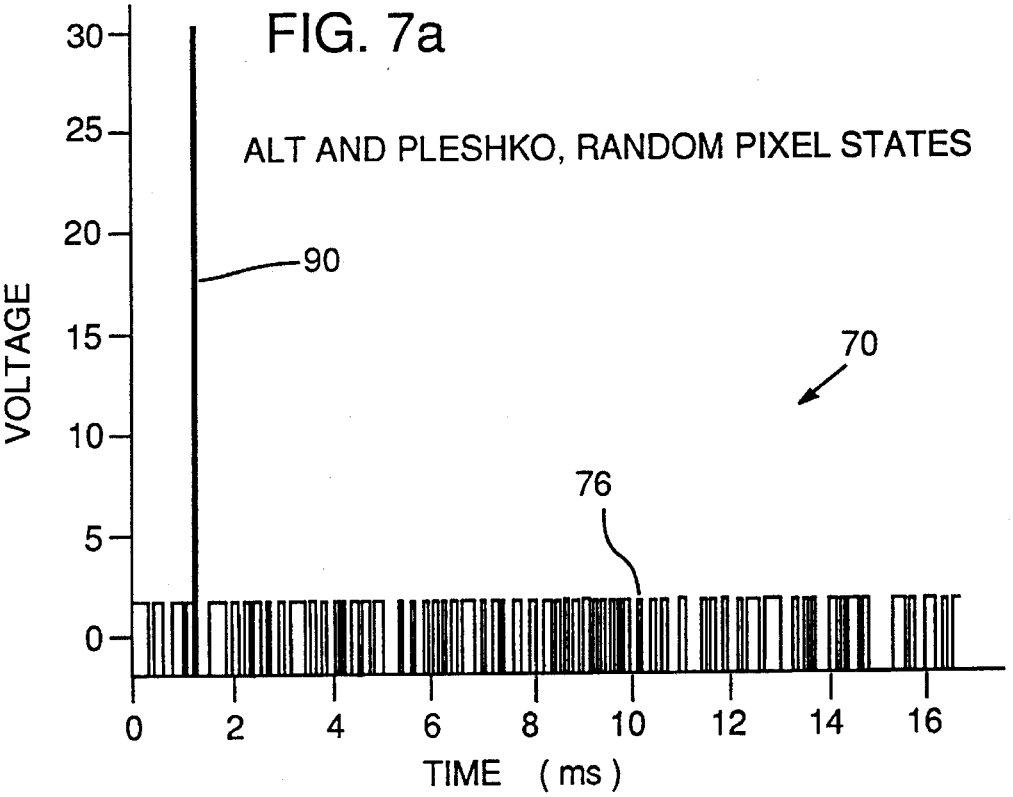
FIGS. 7*a*, 8*a*, and 9*a* are graphs showing exemplary applied pixel voltage waveforms of a pixel in an ON optical state during a frame period of Alt and Pleshko addressing. The optical states of the other pixels in the same columns as the pixel whose applied pixel voltage waveform is illustrated in each of FIGS. 7*a*, 8*a*, and 9*a* are, respectively, random, OFF, and alternately ON and OFF.
Figure 8B:
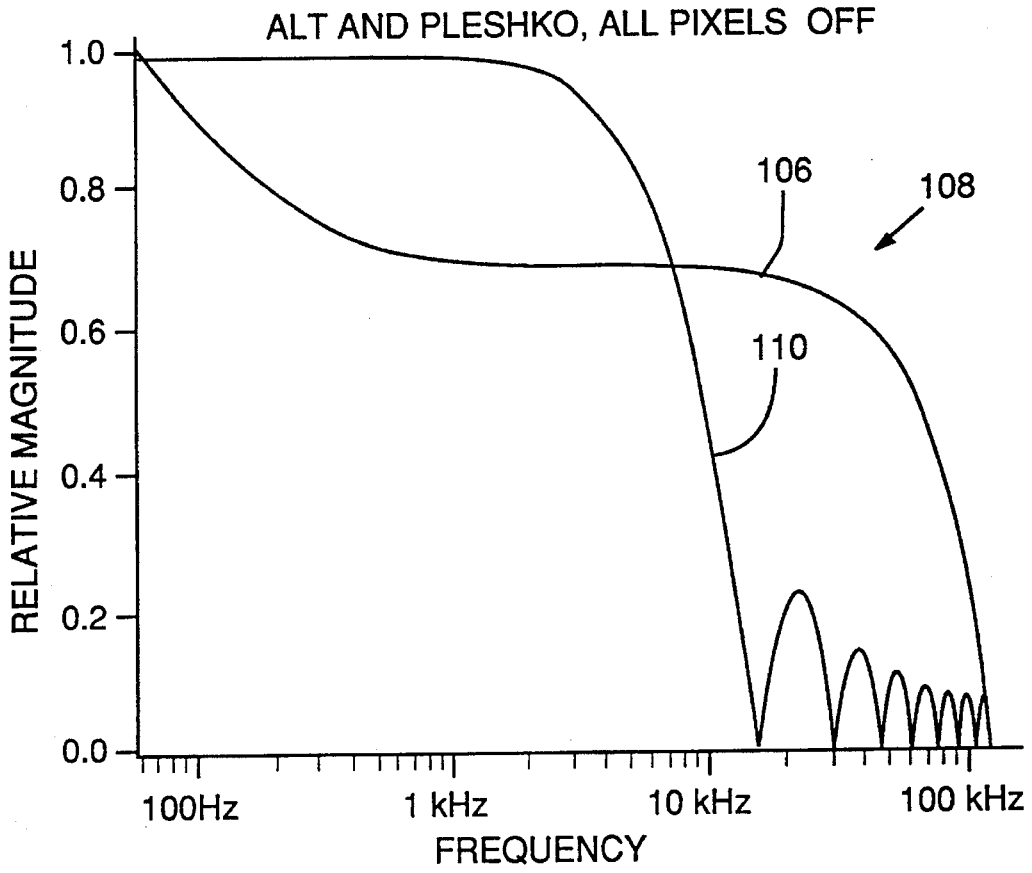
Figure 8A:
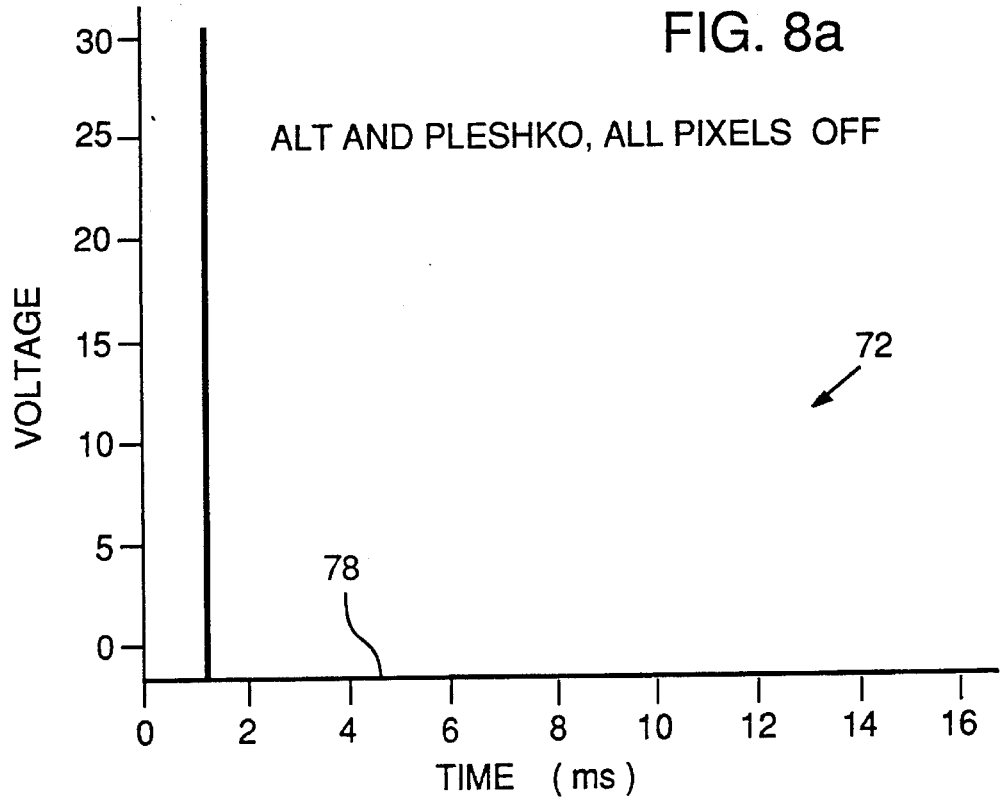
Figure 9B:
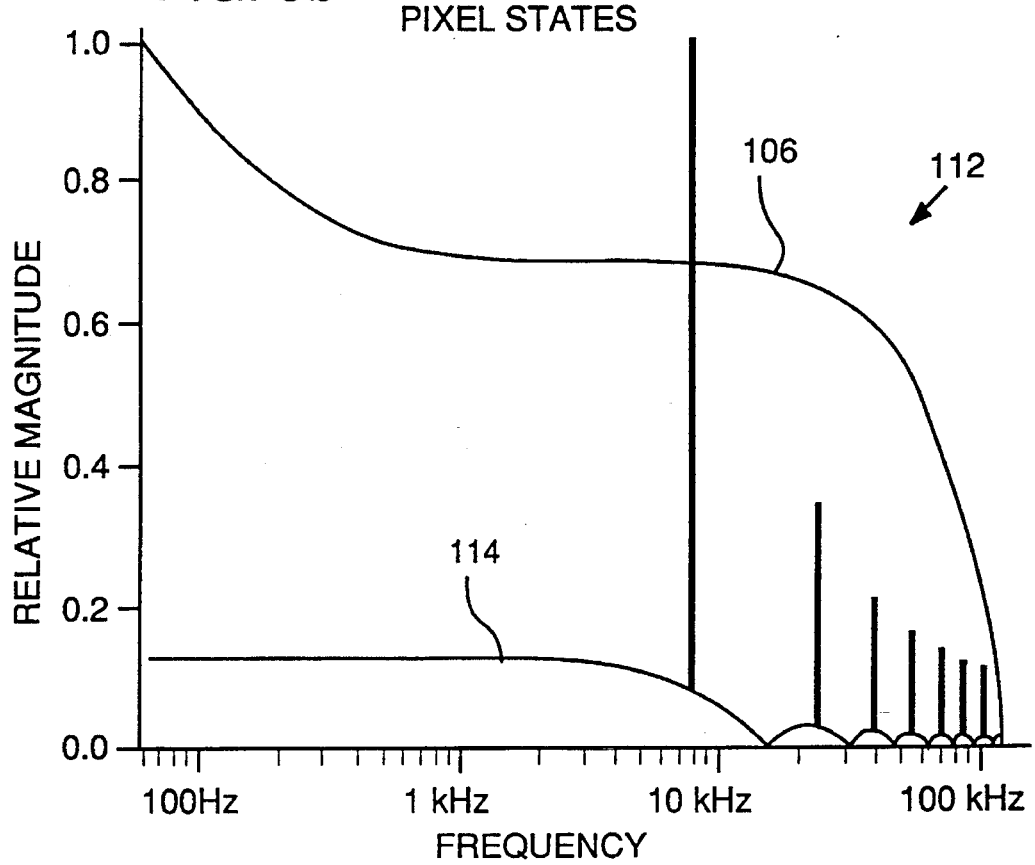
Figure 9A:
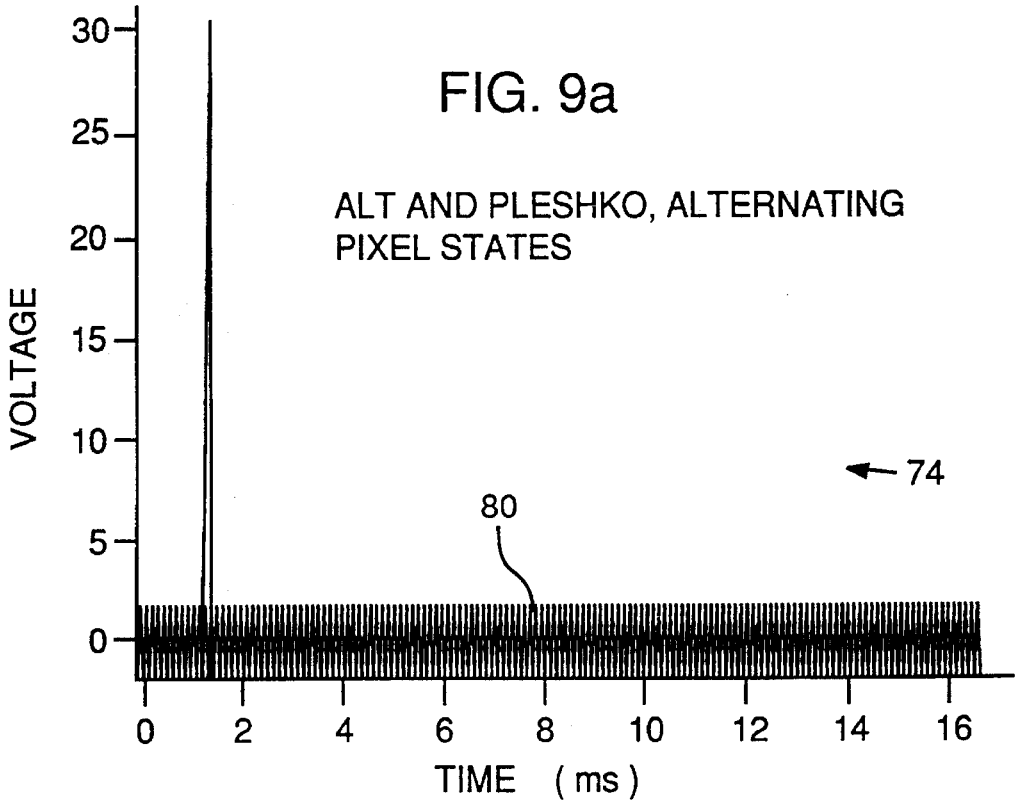

FIGS. 7*a*, 8*a*, and 9*a* are respective graphs 70, 72, and 74 showing respective applied pixel voltage waveforms 76, 78, and 80 that during a frame period for pixels 14 addressed by an Alt and Pleshko addressing system. The applied pixel voltage waveform for a particular pixel 14 is determined by all of the addressing signals applied to the corresponding row and column electrodes 10 and 11, including addressing signals applied when the specific pixel is not selected. The desired optical states of other pixels 14 addressed by the same column electrode 11, therefore, affect the applied pixel voltage waveform across pixel 14.

FIG. 7*a* shows applied pixel voltage waveform 76 across a pixel 14 in a column 18 in which the optical state of the other pixels 14 are random, i.e., each pixel 14 in column 18 has an equal probability of being ON or OFF. The 30 V spike 90 represents the addressing interval in which the row 16 of the pixel 14 is selected. The remainder of the frame period represents addressing intervals in which other rows 16 are addressed. FIG. 7*b* is a frequency domain plot 92 showing spectral components 94 of applied pixel voltage waveform 76 of FIG. 7*a*. The height of curve 94 at a particular frequency represents the relative magnitude of the voltage component at that frequency, and the area under curve 94 in a particular frequency range compared to the total area under curve 94 represents the relative energy of the addressing signal in that frequency range.

Superimposed onto a curve 94 is a curve 106, similar to that of FIG. 1, showing the variation of brightness with frequency. Comparing spectral voltage components 94 with curve 106 shows that frequency components 94 appear spread across frequency bands 52, 54, and 56, defined in FIG. 1, with the signal energy predominantly in the low 52 and medium 54 frequency bands. The optical response of display 3 and, therefore, the brightness of pixels 14, depends upon the location of signal energy along curve 106. Signal components in low frequency band 52 contribute more to brightness than components in the high frequency band 56.

FIG. 8*a* shows the applied pixel voltage waveform 78 for a pixel 14 in a column 18 in which the optical state of all of the other pixels 14 are OFF, i.e., a negative voltage is applied to column electrode 11 only during the addressing interval in which the row 16 including the pixel 14 is selected, and a positive voltage is applied during all of the remaining addressing intervals. FIG. 8*b* is a frequency domain plot 108 showing frequency components 110 of the applied pixel voltage 78. FIG. 8*b* also includes a curve 106 similar to that of FIG. 1, showing the variation of optical response with frequency. A comparison of spectral voltage components 110 with curve 106 shows that the spectral components are distributed primarily in the low and medium frequency bands 52 and 54.

FIG. 9*a* shows the applied pixel voltage waveform 80 for a pixel 14 in a column 18 in which the optical states of the other pixels 14 are alternately OFF and ON. FIG. 9*b* is a frequency domain plot 112 showing spectral components 114 of applied pixel voltage waveform 80 for pixel 14. FIG. 9*b* also includes curve 106 similar to that of FIG. 1, showing the variation of optical response with frequency. A comparison of spectral voltage components 114 with curve 106 shows that the spectral components are spread throughout all three frequency bands 52, 54, and 56.

FIGS. 7*b*, 8*b*, and 9*b* together show that the spectral component distribution of a particular applied pixel voltage waveform depends upon the displayed image and, in particular, upon the optical states of other pixels within the same column 18, even at a constant rms value. The brightness of an individual pixel 14, which is a function of the frequency of the voltage components, will therefore vary depending upon the optical state of other pixels 14 in the column even though the rms value of the pixel voltage remains constant.

A preferred method of reducing this effect is to modify the addressing voltage waveforms (without affecting the rms value) to produce addressing signals in which the majority of the spectral components are distributed in the middle frequency band 54 where the optical response of the display is relatively independent of frequency. This will achieve a uniform optical response that is essentially dependent on the rms voltage alone.

Figure 10A:
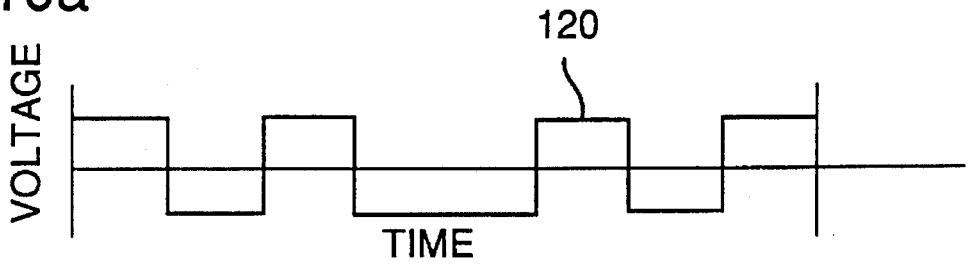
FIGS. 10*a*–10*c* are graphs showing, respectively, part of a typical row signal used in an Active Addressing™ technique, a Manchester modulation signal, and a modified row signal that results from modulating the row signal of FIG. 10*a* with the modulation signal of FIG. 10*b*.
Figure 10B:
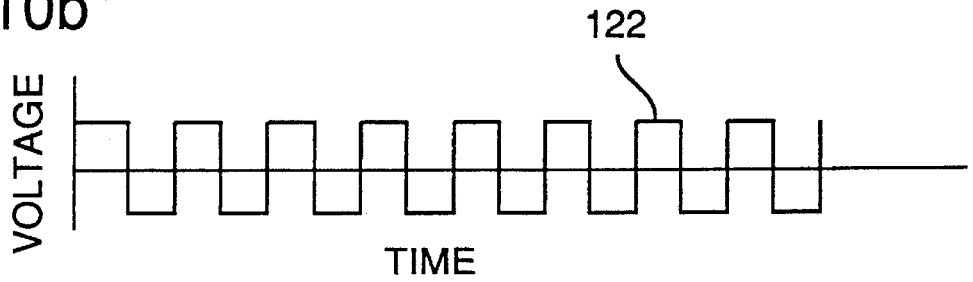
Figure 10C:
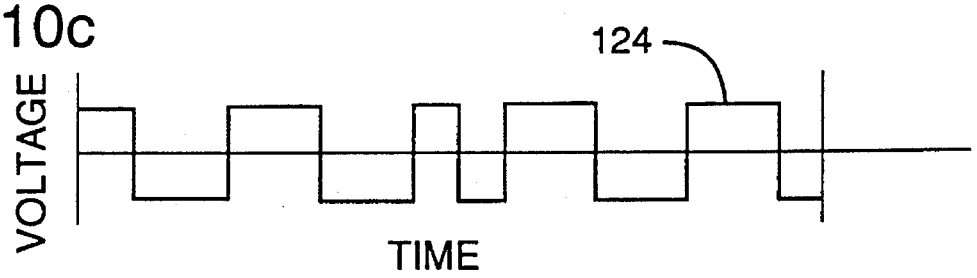

A preferred method of modifying the pixel voltage waveform is to modulate the row and column addressing signals within the addressing time intervals $\Delta t_k$ using a Manchester modulating signal. FIG. 10*a* shows a portion of an Active Addressing™ technique row-addressing signal 120. FIG. 10*b* shows a typical Manchester modulation signal 122. FIG. 10*c* shows a modulated addressing signal 124 that results from modulating addressing signal 120 with modulation signal 122.

Figure 11:
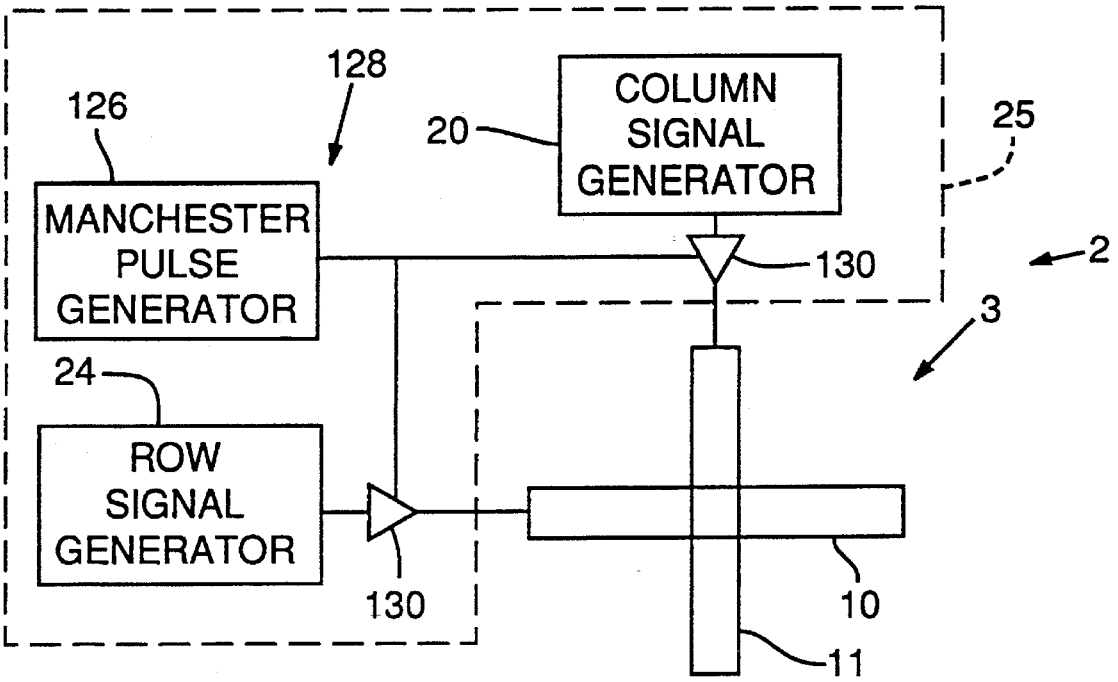
FIG. 11 is a schematic diagram of a circuit for modulating the addressing signals in the manner shown in FIG. 10.

FIG. 11 shows a Manchester modulation circuit 128 comprising a Manchester pulse generator 126 and two inverters 130. Manchester pulse generator 126 supplies Manchester modulation pulses 122 to inverters 130 to reverse the polarity of both the row and column signals during part of the addressing interval period, thereby changing the frequency of the pixel voltage waveform spectral components. The rms voltage across pixel 14 is not changed, because the polarity of both row and column voltages are reversed by the Manchester pulse, so the absolute value of the pixel voltage, which is the difference between the row and column voltages, remains unchanged. Circuit 128 comprises part of one embodiment of addressing signal generator 25 that also includes column signal generator 20 and row signal generator 24. Alternatively, modulation pulses could also be generated within column signal generator 20 and row signal generator 24.

Figure 12B:
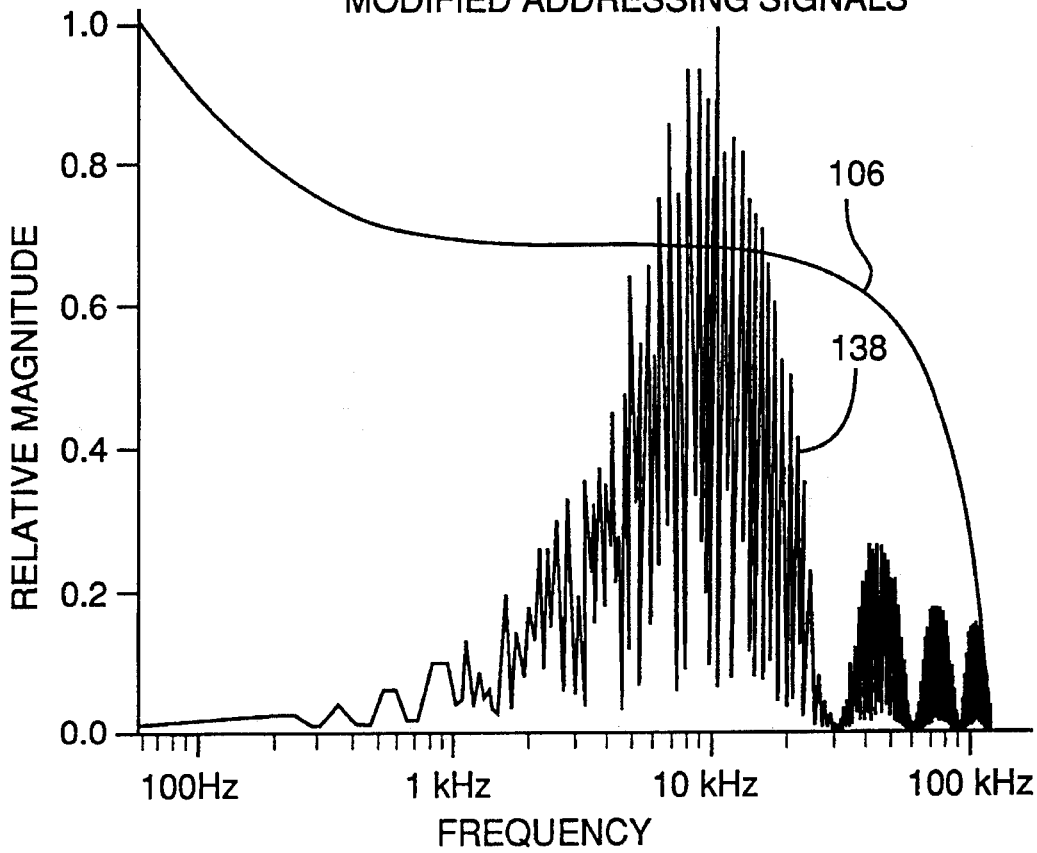
FIGS. 12*a*, 12*b*, 13*a*, 13*b*, 14*a*, and 14*b* are graphs analogous to those of the respective FIGS. 7*a*–9*b*, with the exception that the Alt and Pleshko addressing signals have been modulated as shown in FIG. 10.
Figure 12A:
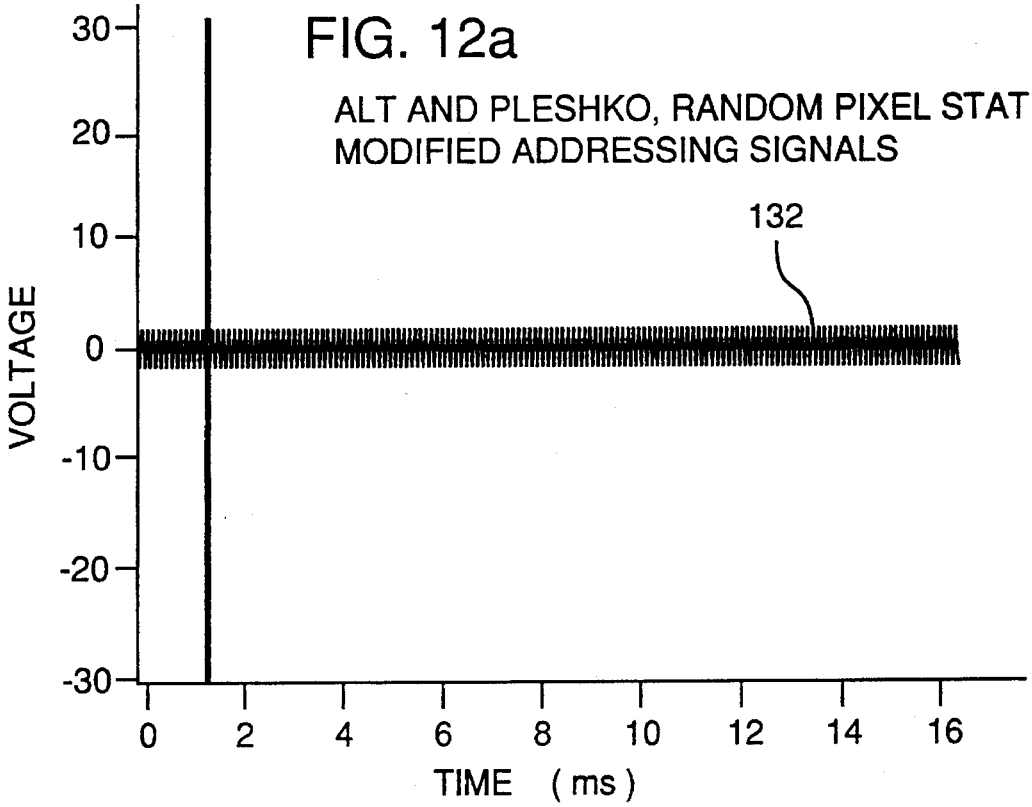
Figure 13B:
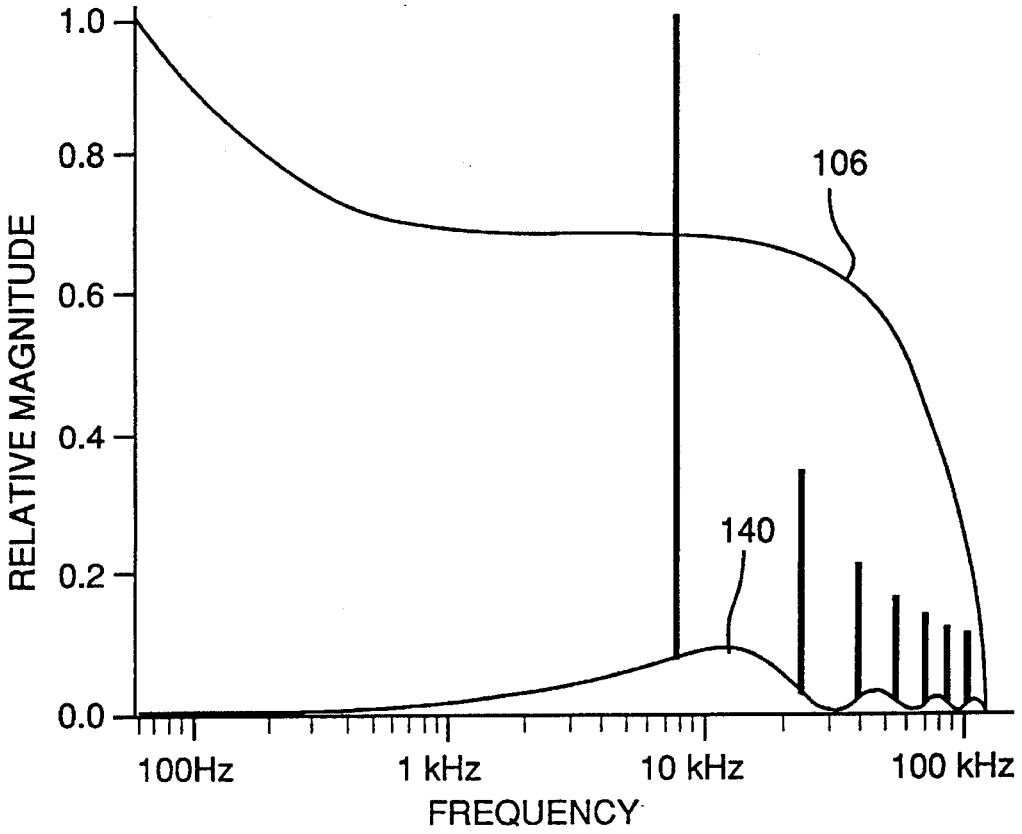
Figure 13A:
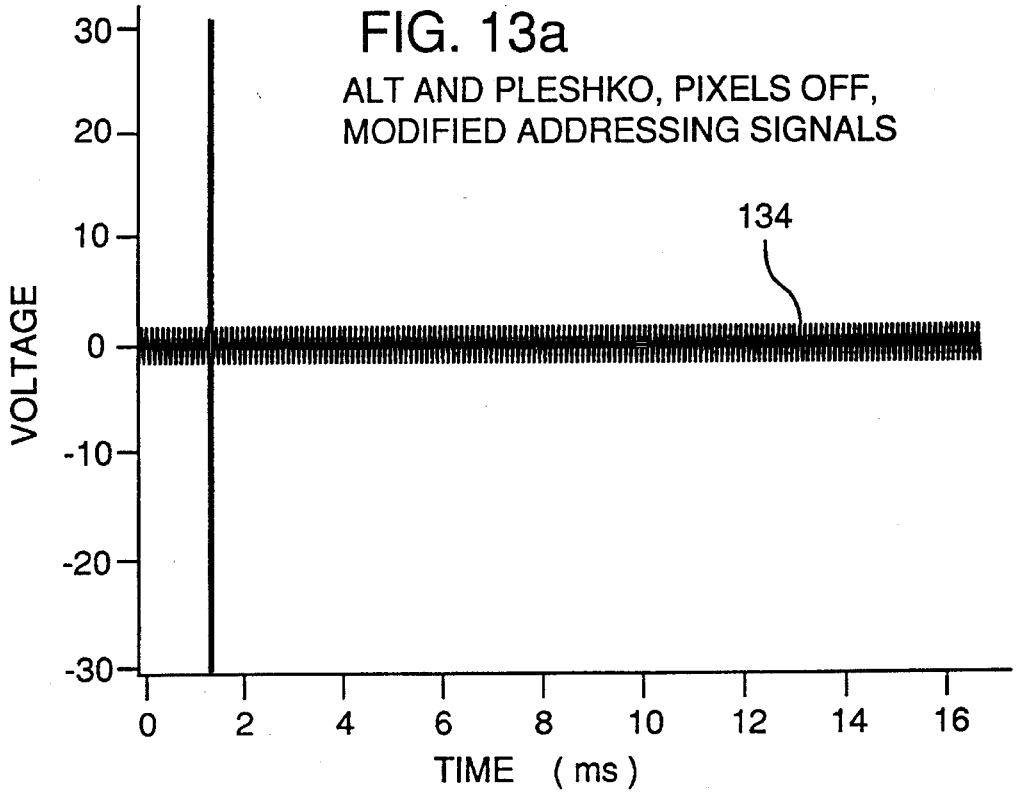
Figure 14B:
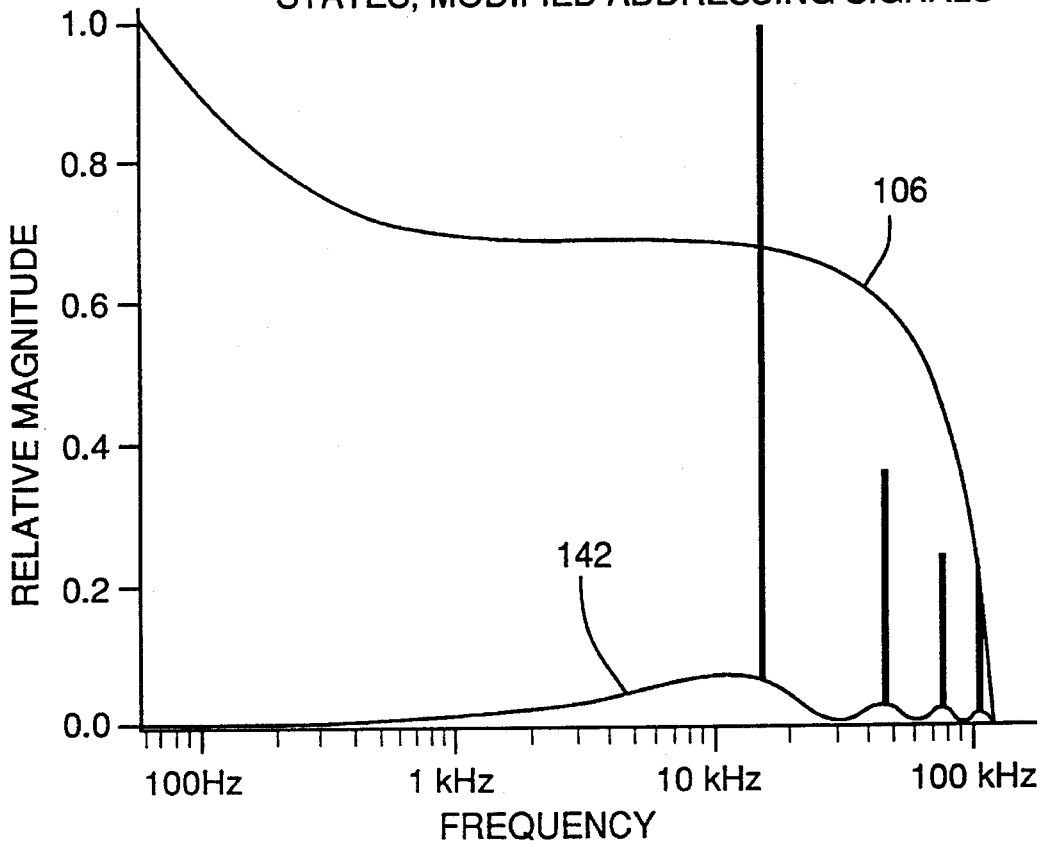

FIGS. 12*a*–14*b* are analogous to FIGS. 7*a*–9*b*, respectively, with the exception that the addressing signals have been modulated by a Manchester signal as shown in FIG. 10. FIGS. 12*a*, 13*a*, and 14*a* show respective applied pixel voltage waveforms 132, 134, and 136 during a frame period of pixel 14 in a column 18 having other pixels 14 whose optical states are random, OFF, and alternating ON and OFF, respectively. FIGS. 12*b*, 13*b*, and 14*b* are frequency domain plots showing respective spectral components 138, 140, and 142 of the applied pixel voltage waveforms shown in respective FIGS. 12*a*, 13*a*, and 14*a*. FIGS. 12*b*, 13*b*, and 14*b* also include, for comparison, curves 106 similar to that of FIG. 1 showing the variation of optical response with frequency.

Figure 14A:
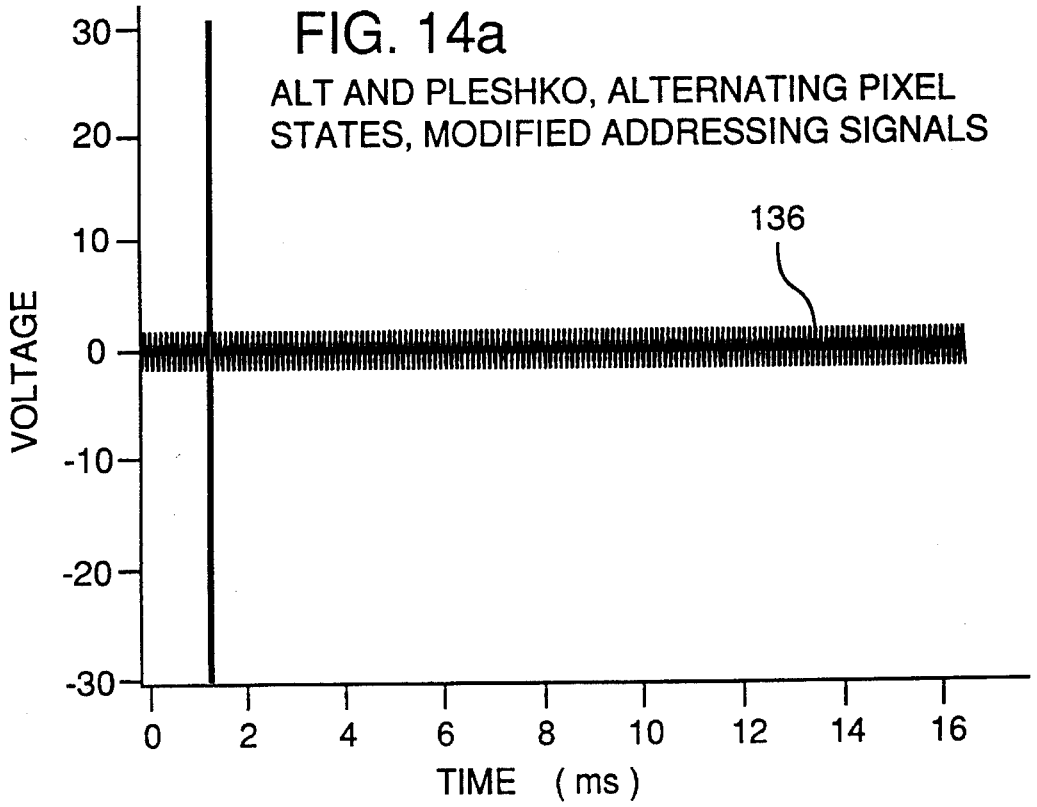

FIGS. 12*b*, 13*b*, and 14*b* show that, compared to FIGS. 7*b*, 8*b*, and 9*b*, the relative areas under the spectral component curves in high and low frequency bands 52 and 56 have decreased while the relative areas under the curves in middle frequency band 54 have increased. The optical responses of the pixels 14 whose pixel voltage waveforms are shown in FIGS. 12*a*, 13*a*, and 14*a* are, therefore, approximately the same despite differences in the image patterns displayed in the column. The image is thus insensitive to the differences in column addressing signals over a frame period caused by differences in the optical state of other pixels 14 in the same column 18. The invention has, therefore, effectively reduced the crosstalk due to the frequency-sensitive nature of the optical response by modifying the addressing signals to shift the spectral components of the pixel voltage waveform to a frequency band in which the optical response is relatively independent of the frequency.

Figure 15A:
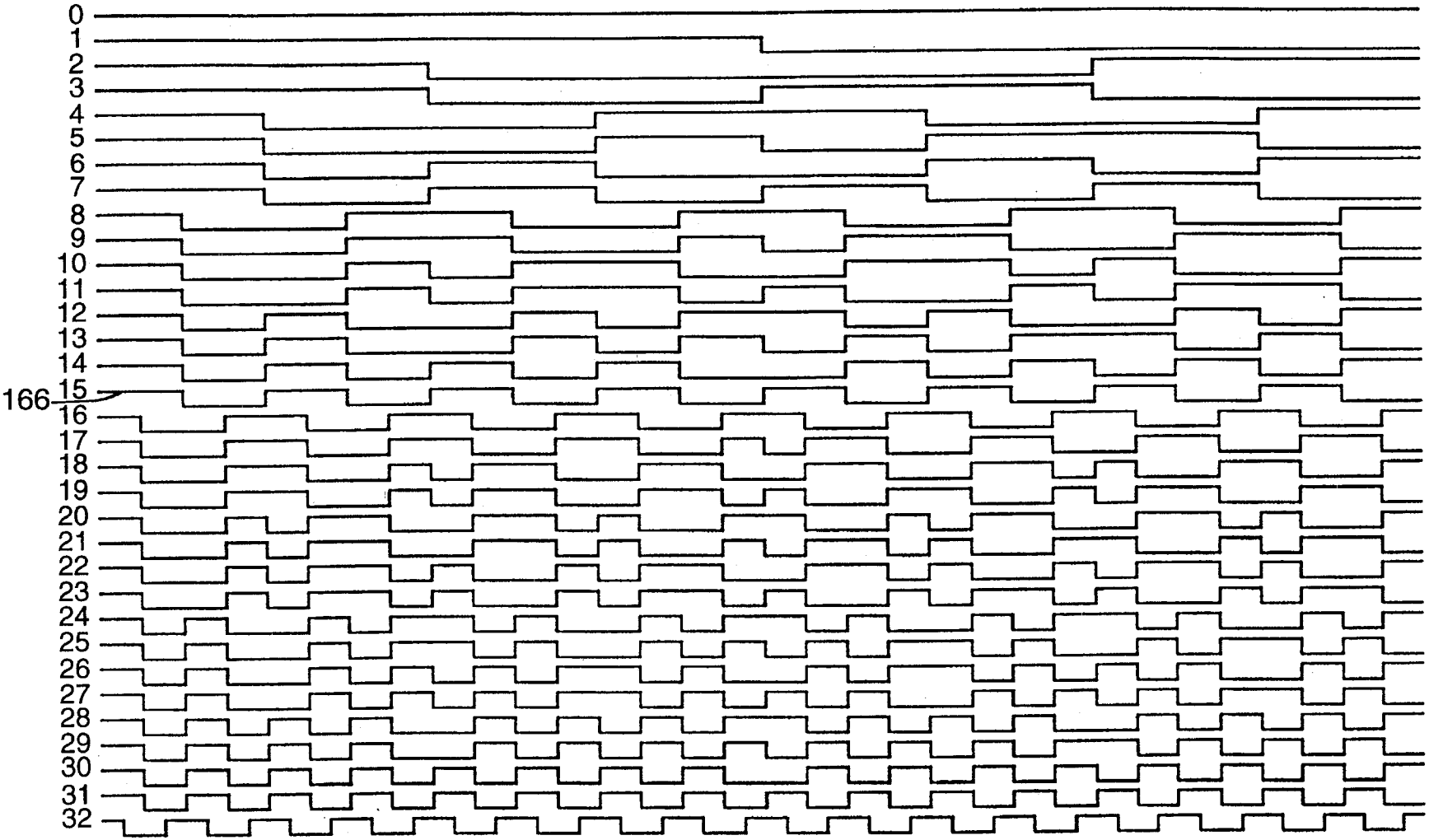
FIGS. 15*a* and 15*b* are graphs showing, respectively, the first and last 33 Walsh functions of a complete orthonormal set of 256 Walsh functions, a subset of which is typically used to drive the electrodes of FIG. 2.
Figure 15B:
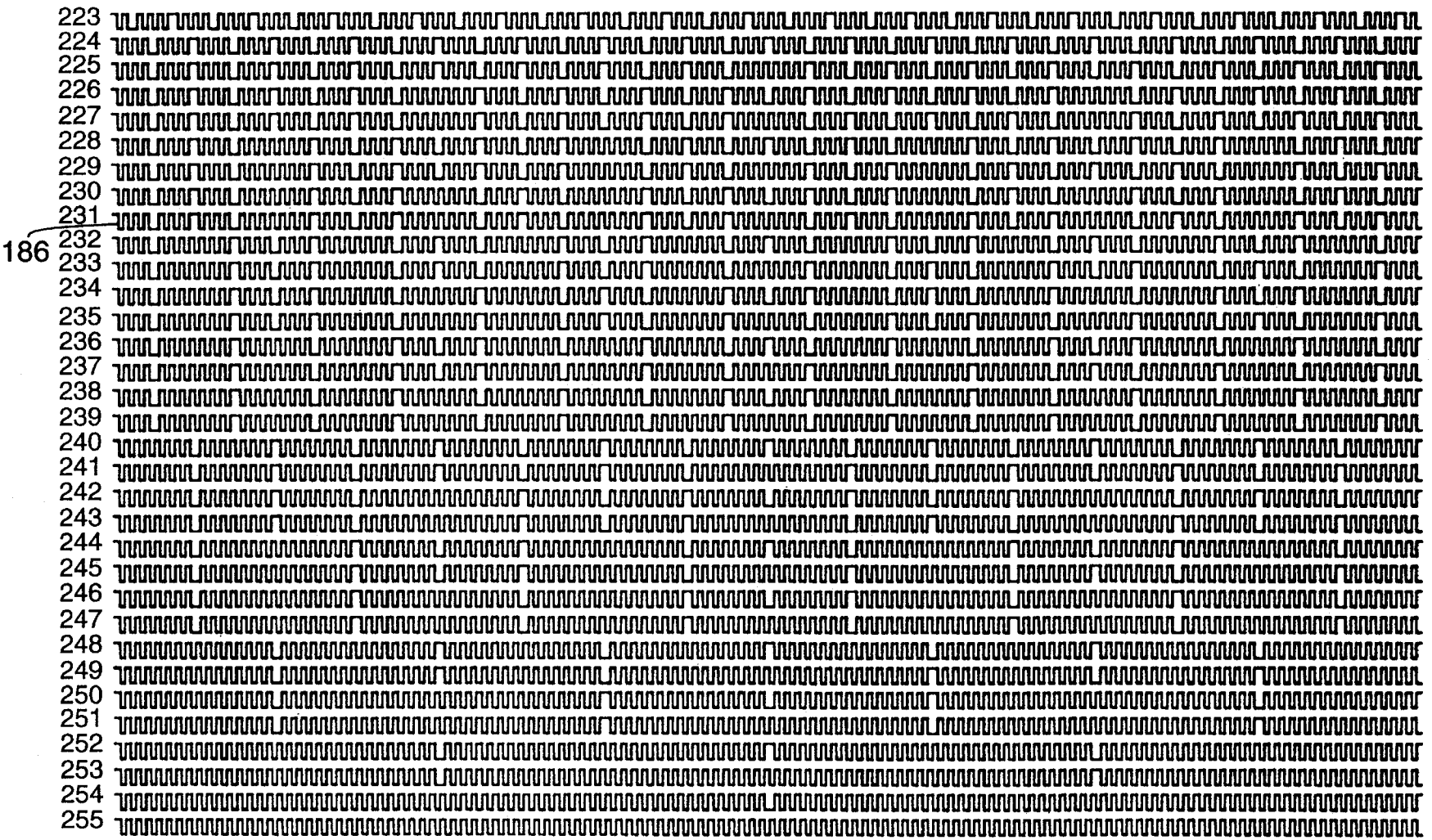
Figure 16A:
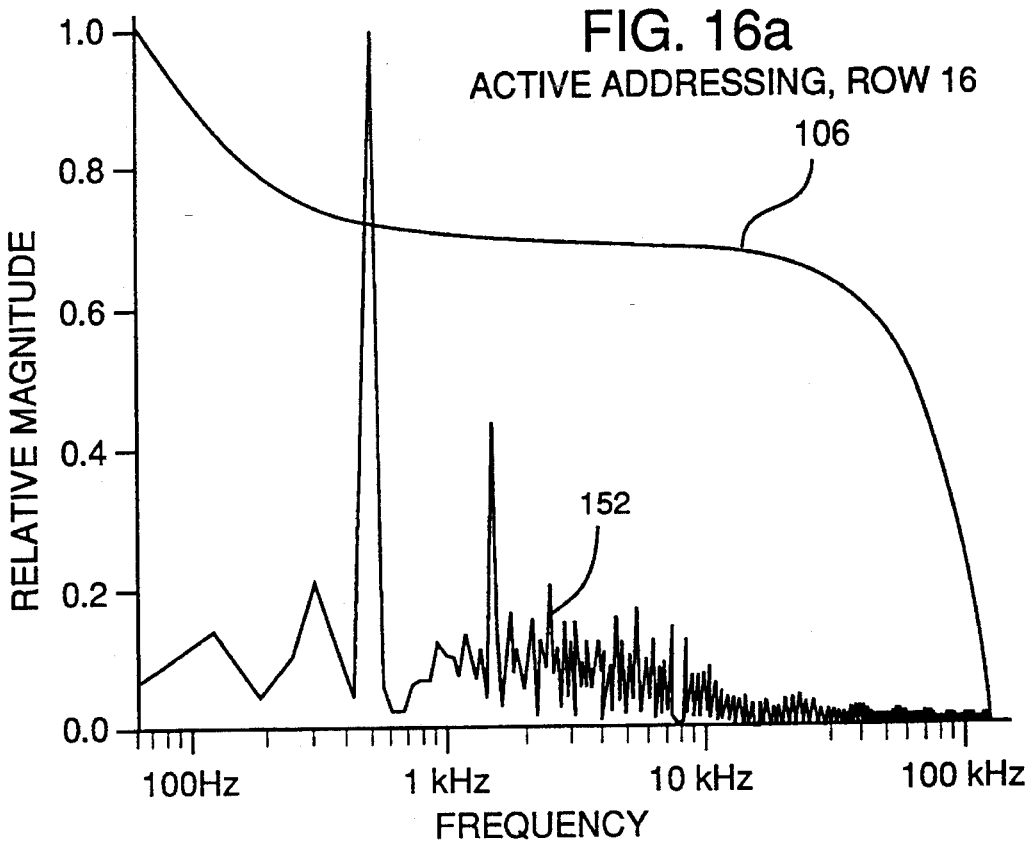
FIGS. 16*a*–16*d* are frequency domain plots showing spectral components of applied pixel voltage waveforms in rows addressed by the 16th function of a set of 256 Walsh functions in display systems displaying four different test images.
Figure 16B:
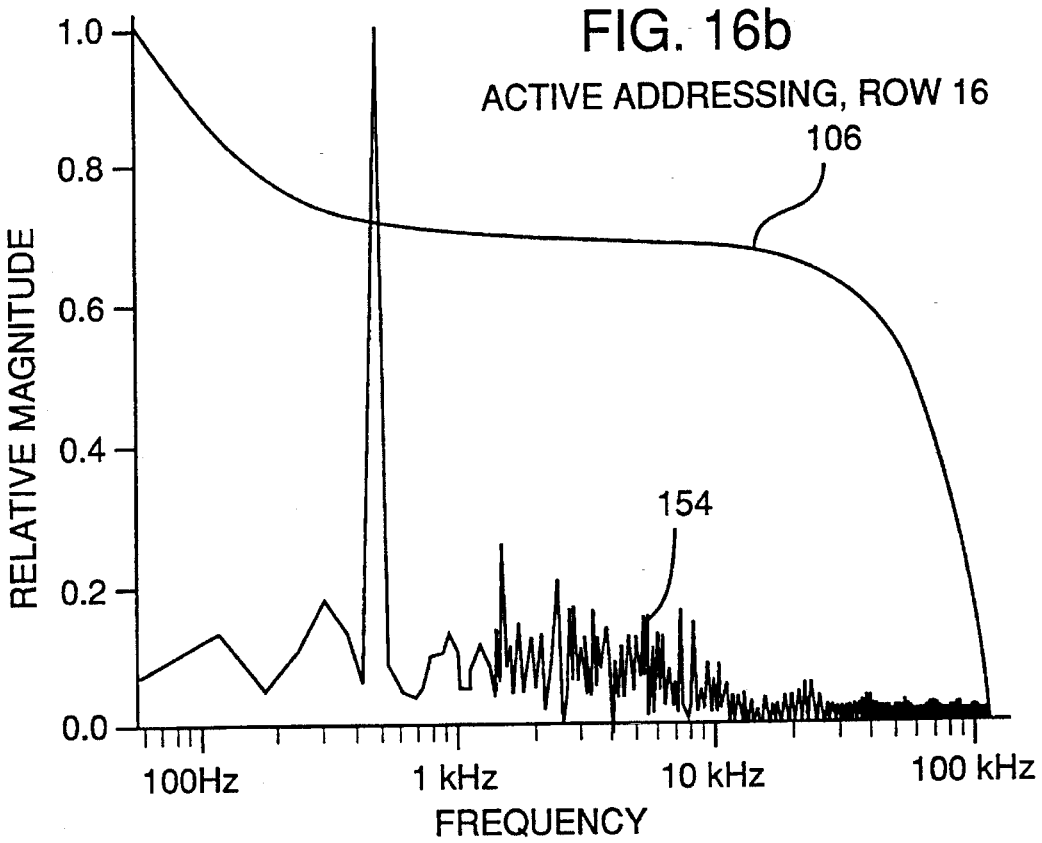
Figure 16C:
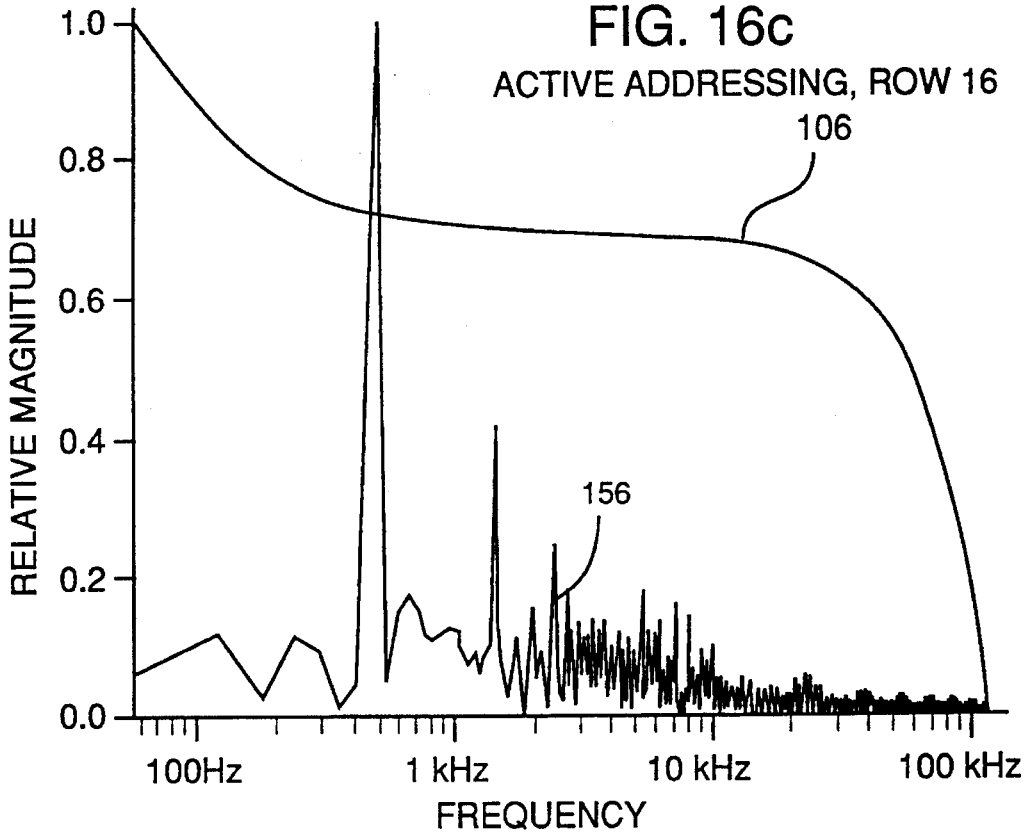
Figure 16D:
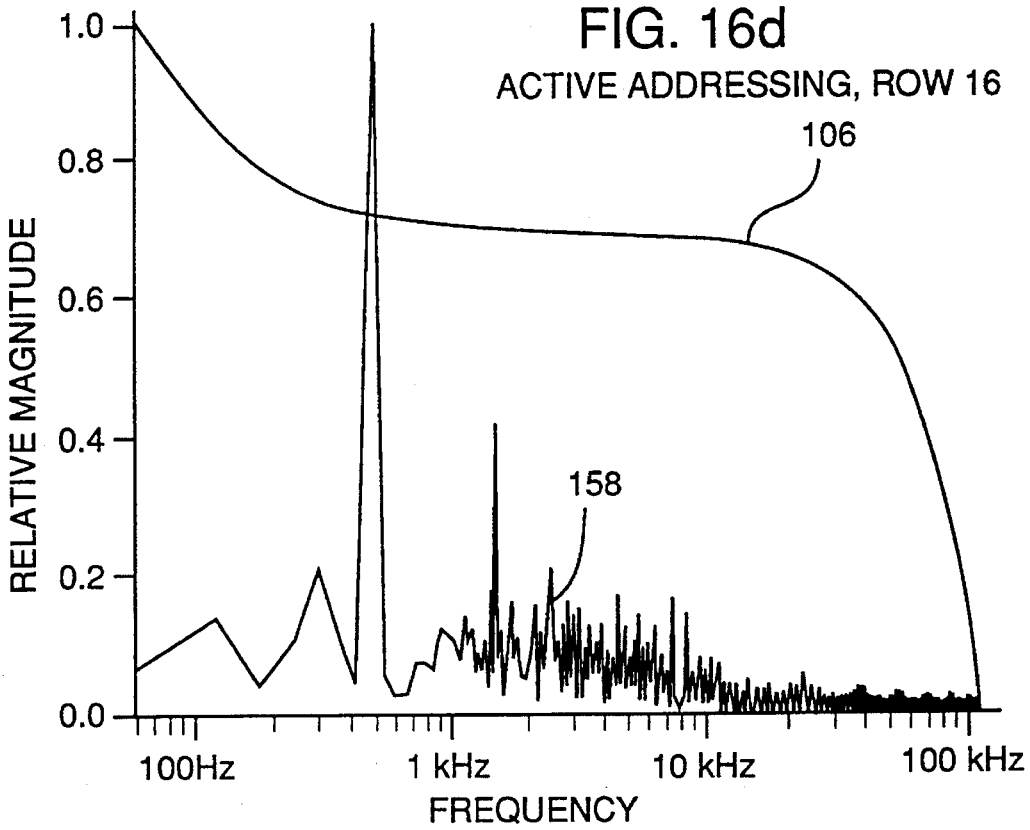
Figure 17A:
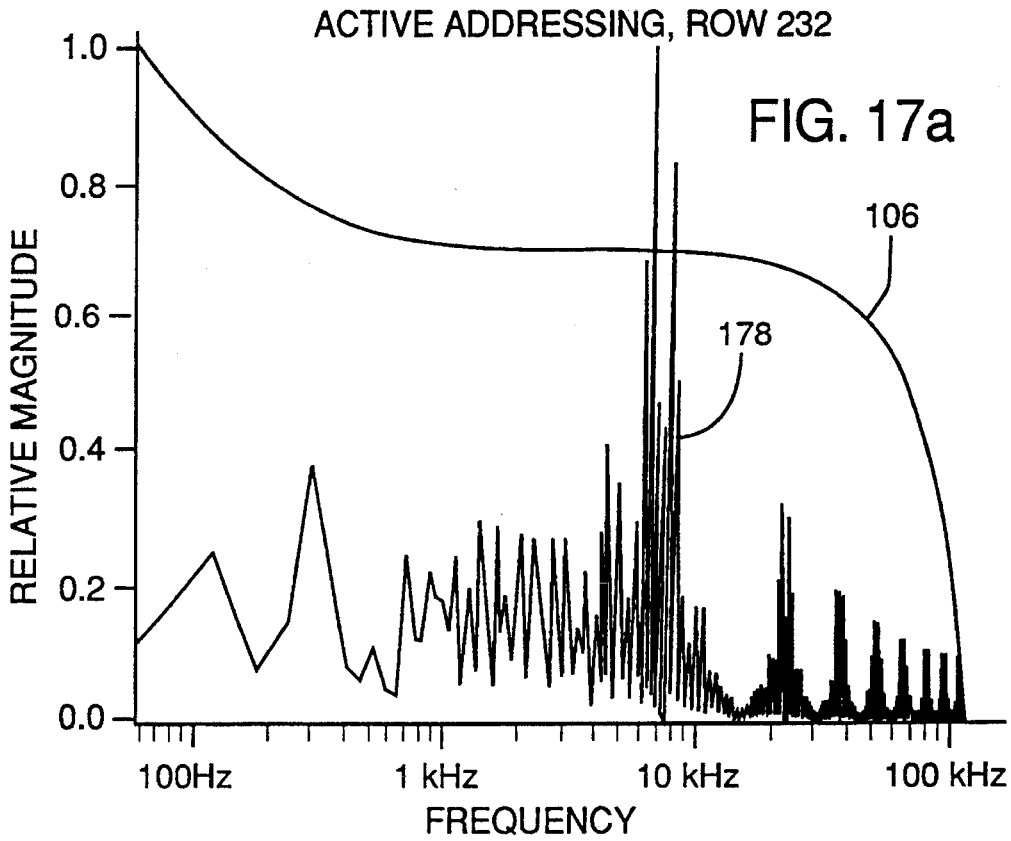
FIGS. 17*a*–17*d* are frequency domain plots showing spectral components of applied pixel voltage waveforms in rows addressed by the 232nd of a set of 256 Walsh functions in display systems displaying the same test images as the display systems in respective FIGS. 16*a*–16*d*.
Figure 17B:
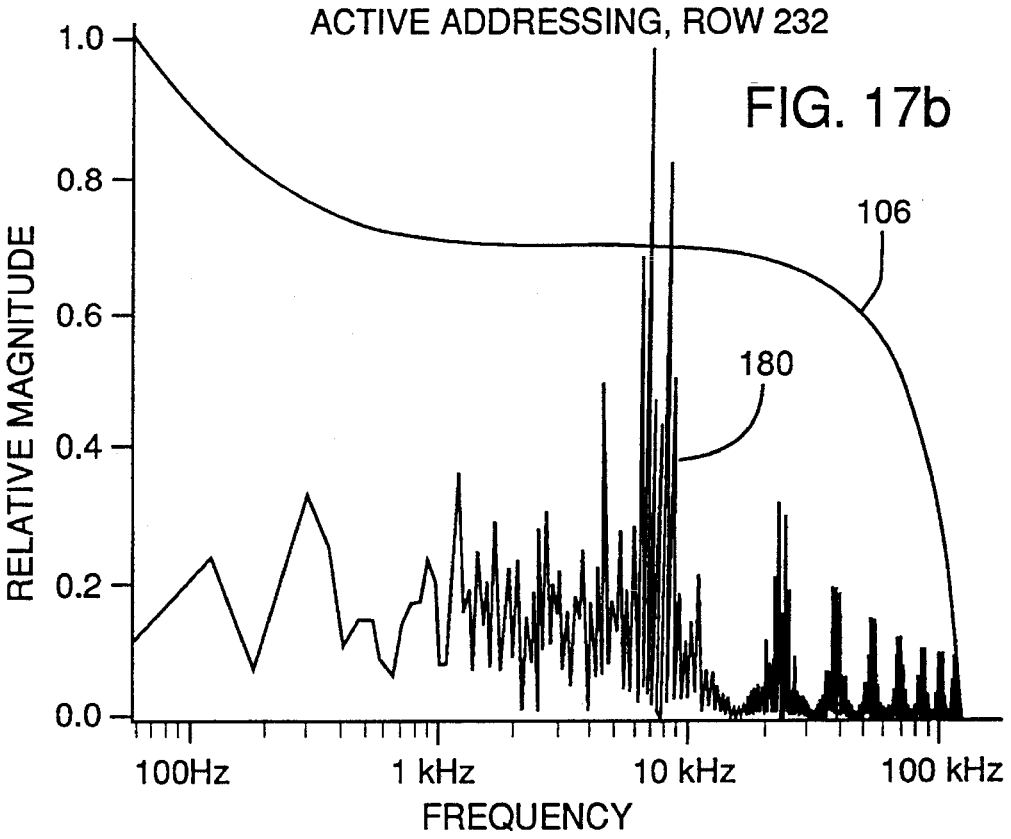
Figure 17C:
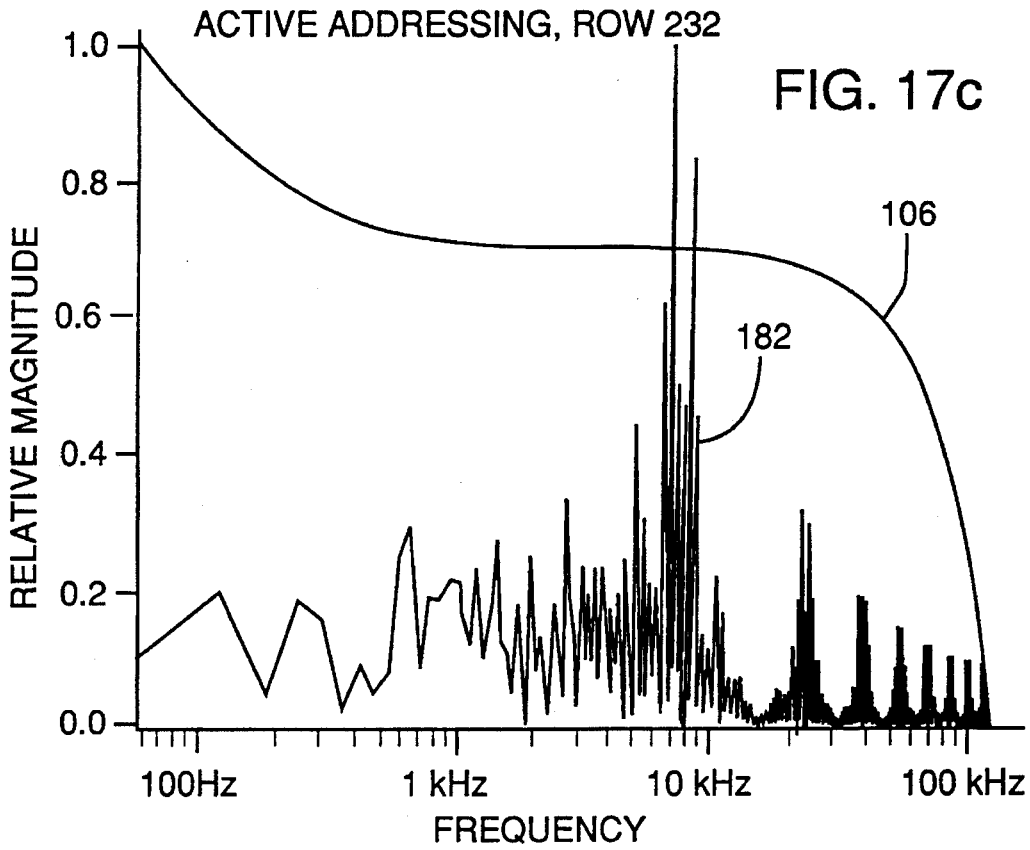
Figure 17D:
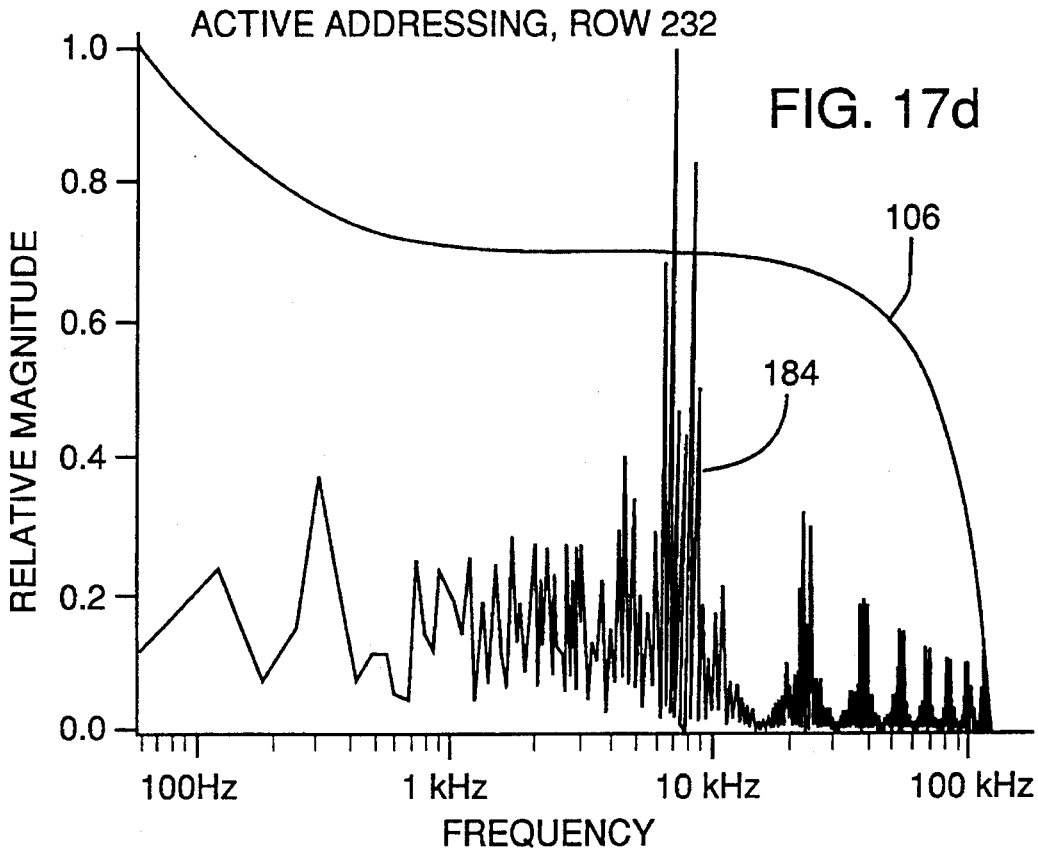
Figure 18A:
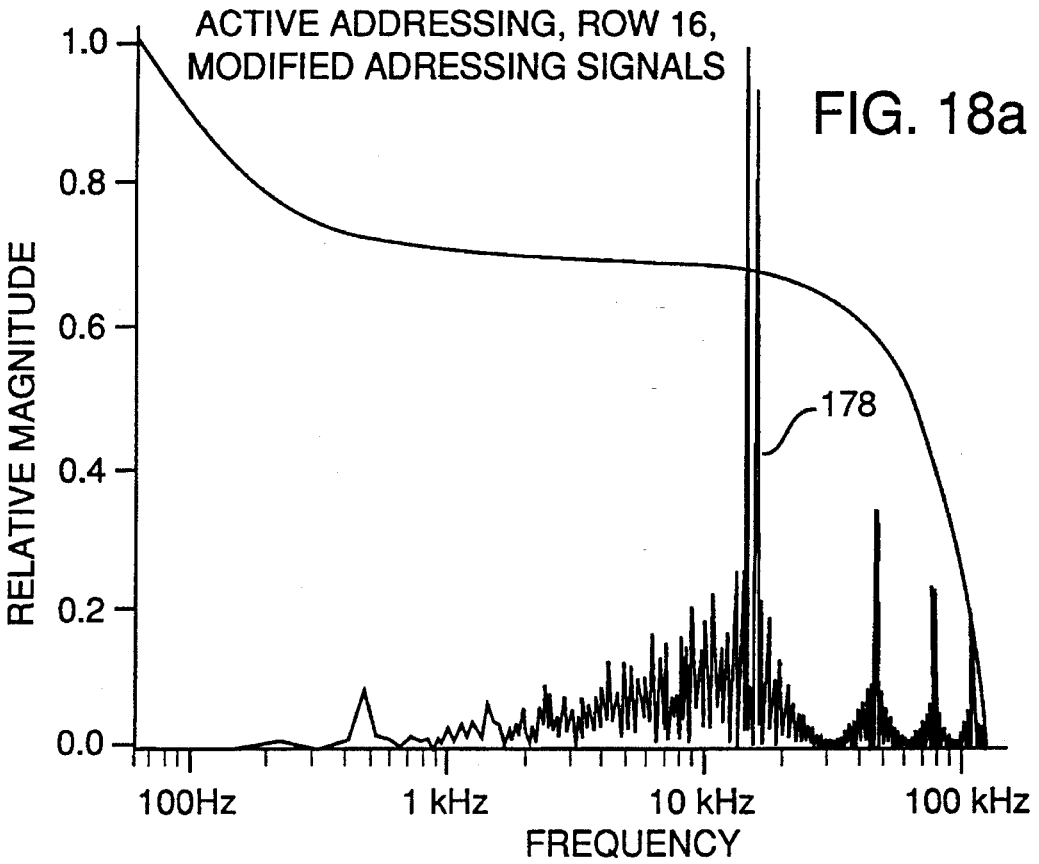
FIGS. 18*a*–18*d* are frequency domain plots of applied pixel voltage waveforms of the same row and test images of respective FIGS. 16*a*–16*d*, with the exception that the addressing signals of FIGS. 18*a*–18*d* have been modulated as shown in FIG. 10.
Figure 18B:
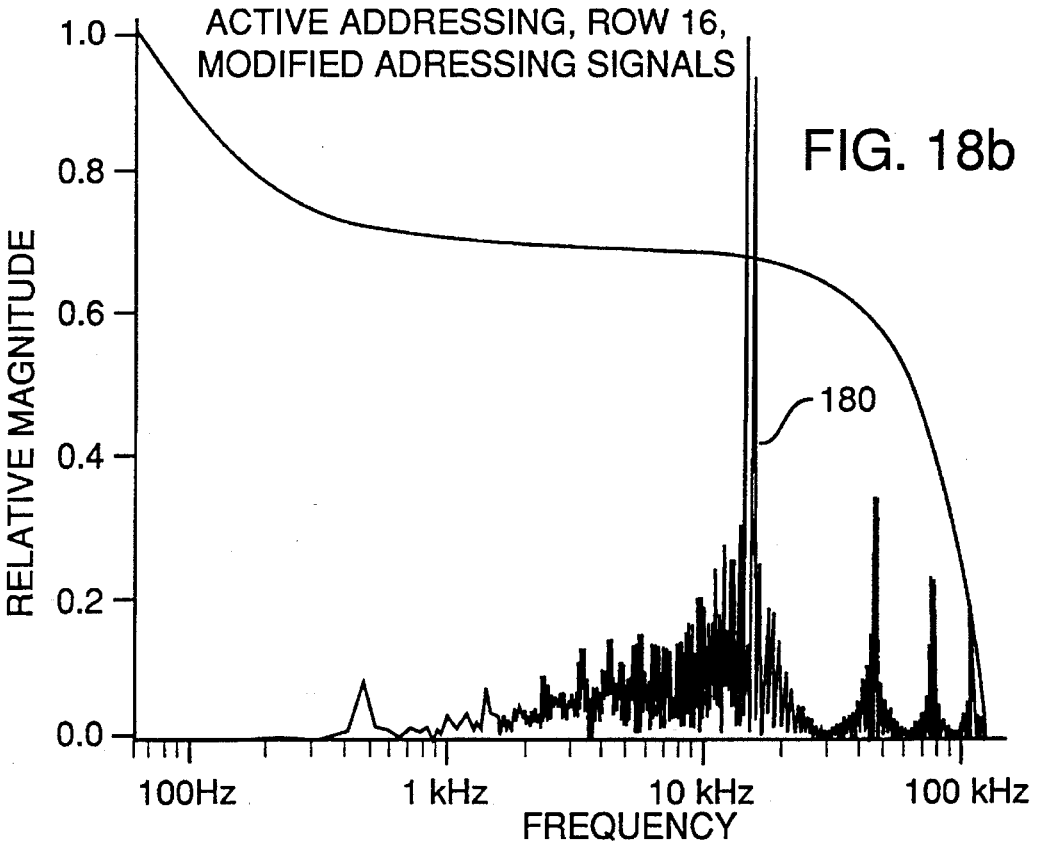
Figure 18C:
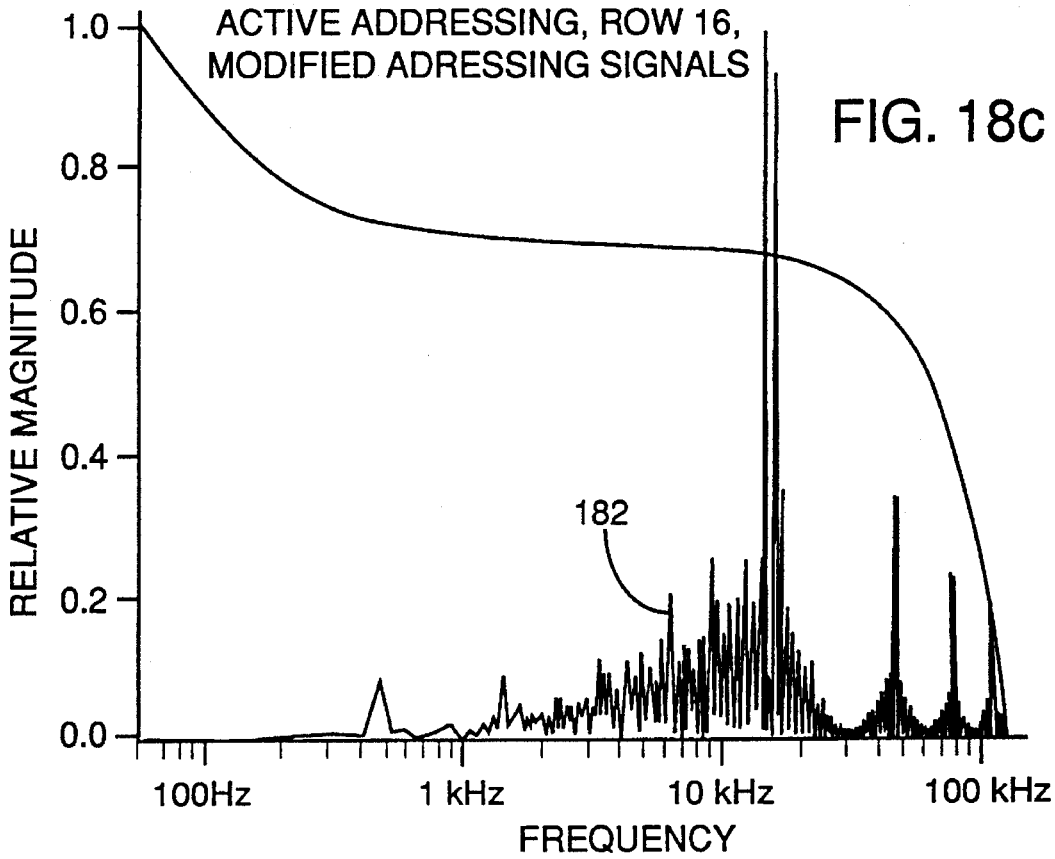
Figure 18D:
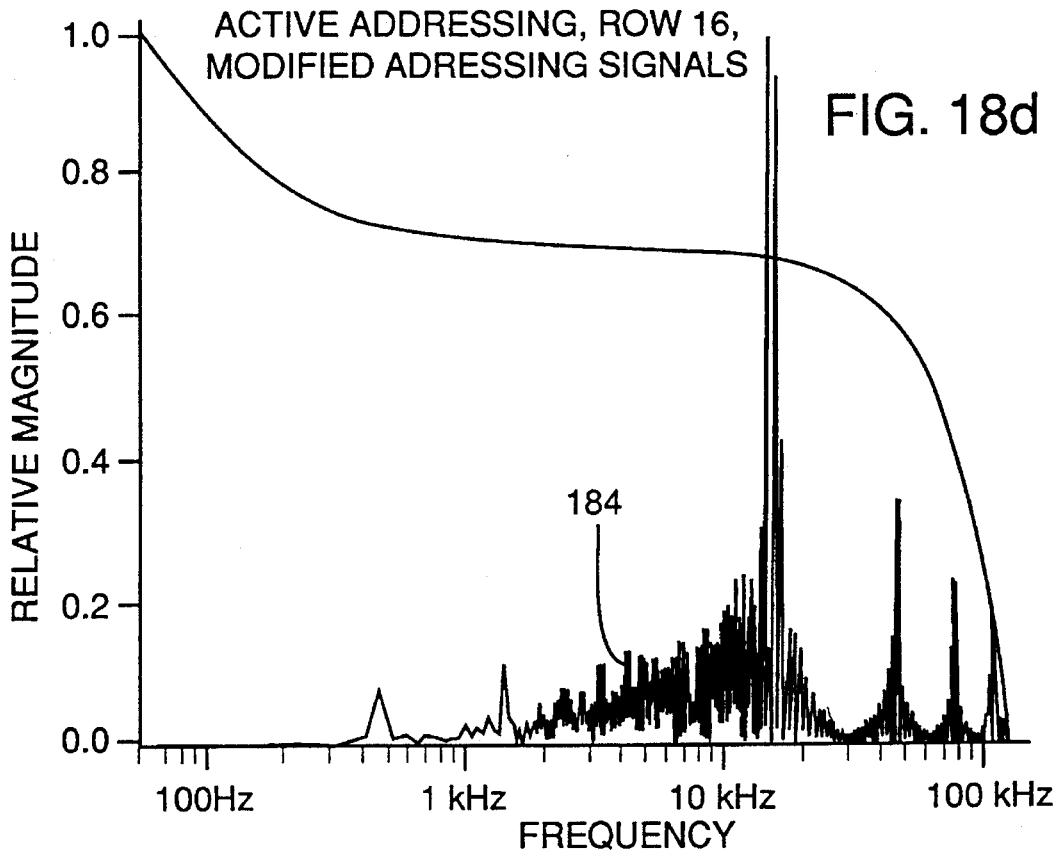
Figure 19A:
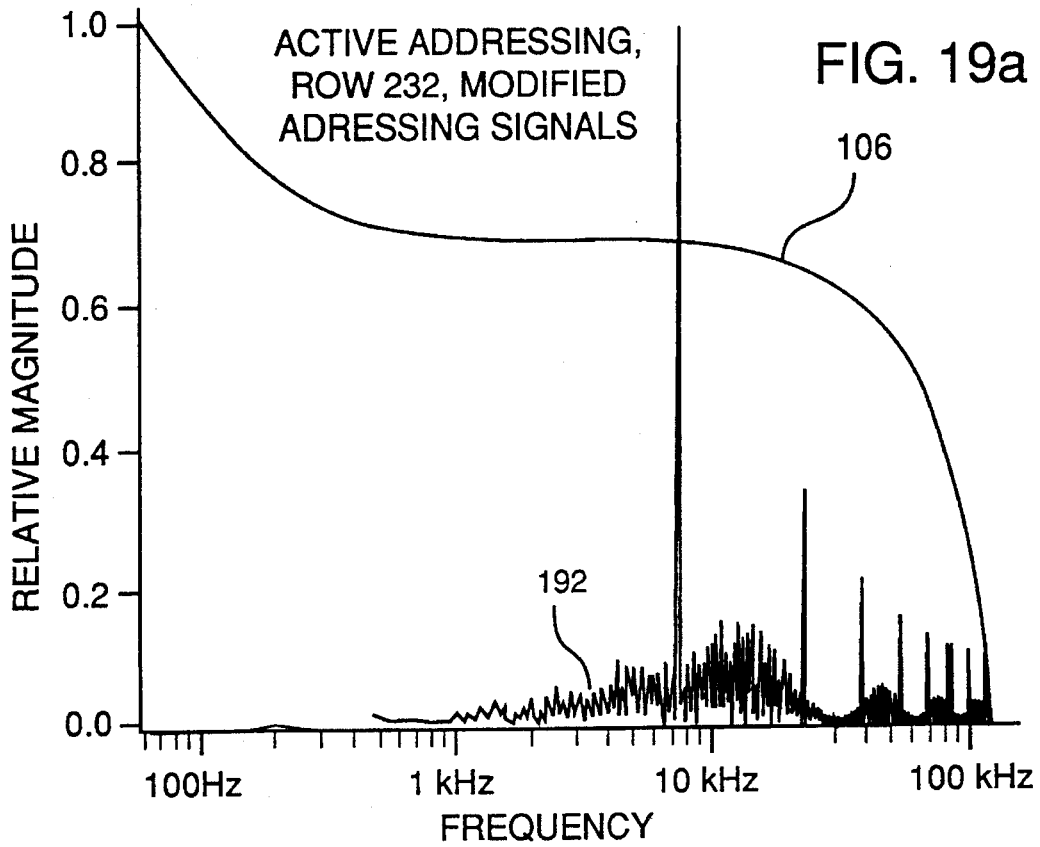
FIGS. 19*a*–19*d* are frequency domain plots of applied pixel voltage waveforms of the same row and test images of respective FIGS. 17*a*–17*d*, with the exception that the addressing signals of FIGS. 19*a*–19*d* have been modulated as shown in FIG. 10.
Figure 19B:
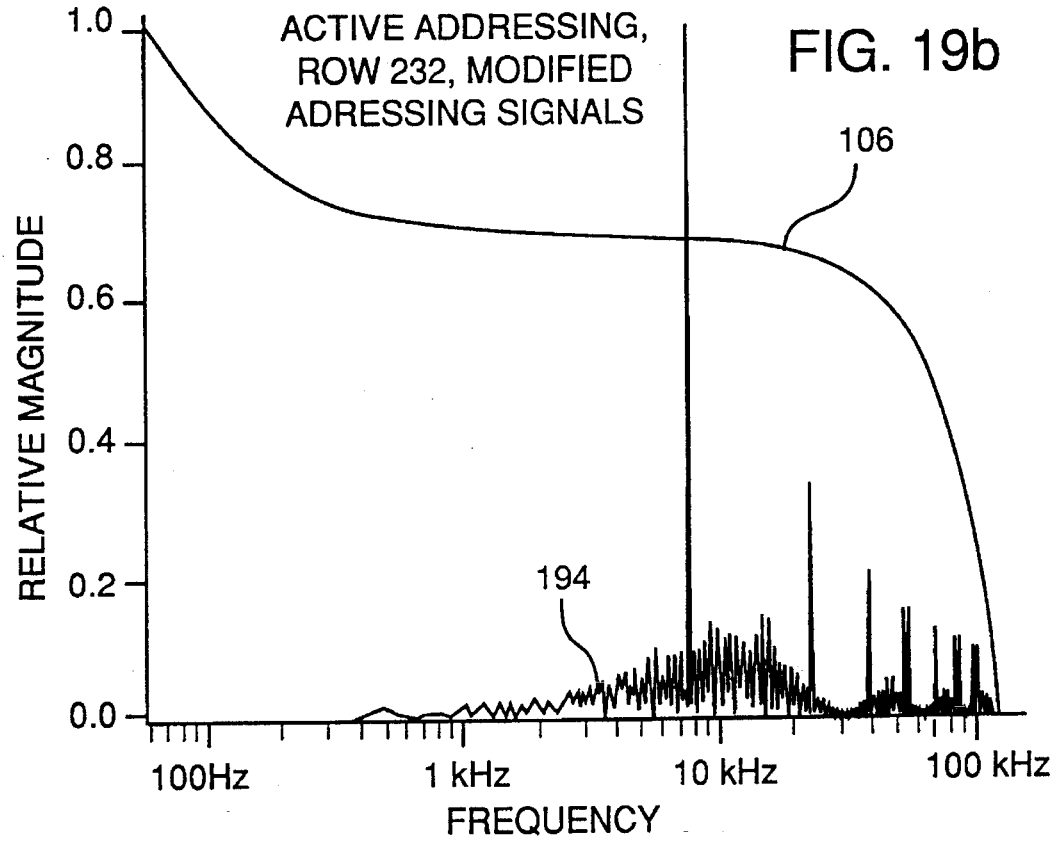
Figure 19C:
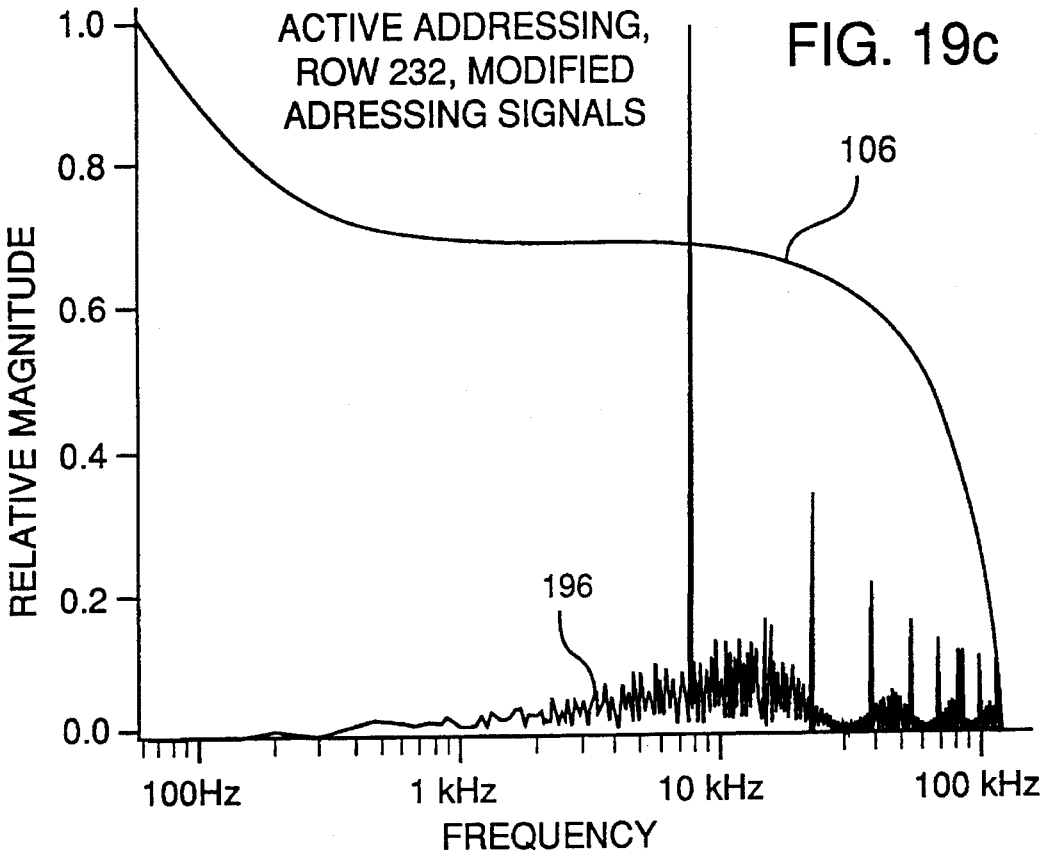
Figure 19D:
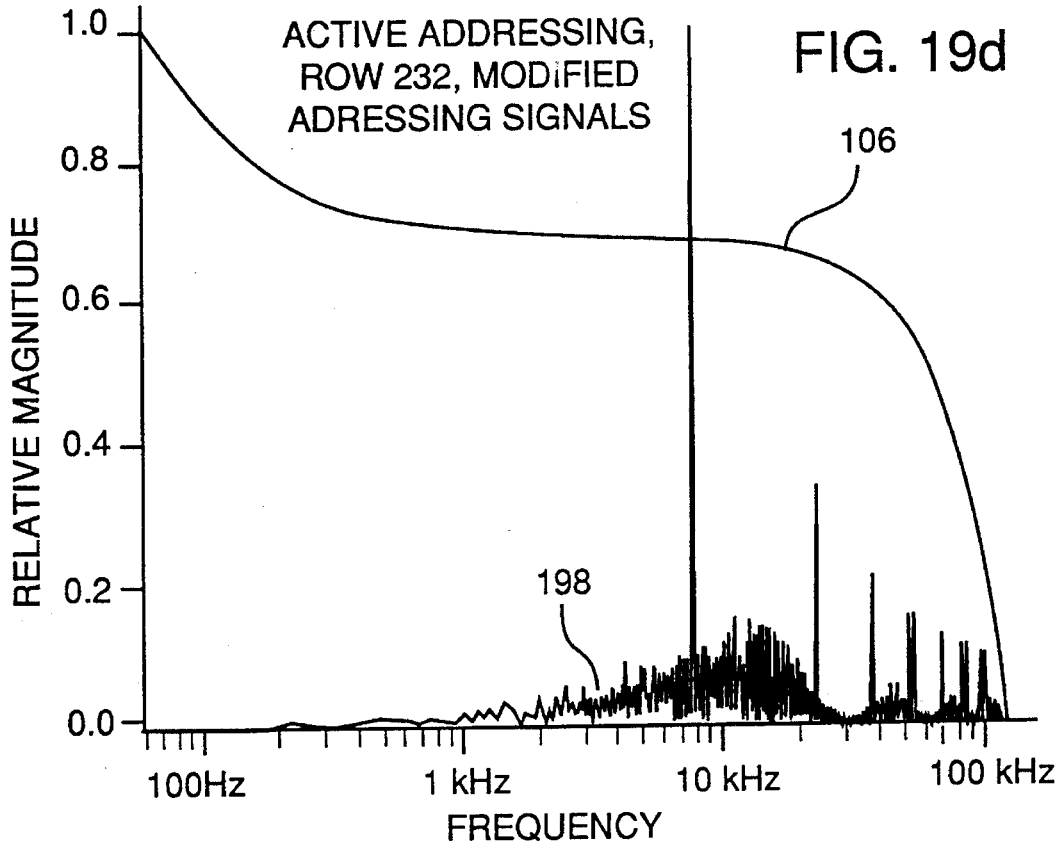

Modulating the addressing signals similarly reduces crosstalk in a preferred system using an Active Addressing™ technique, as described in copending U.S. patent application Ser. No. 07/678,736. In an Active Addressing™ technique, the row signals typically comprise a set of orthonormal functions, such as Walsh functions as shown in FIGS. 15*a*–15*b*, with a different function of the set being applied to each row electrode 10. The column signals applied to column electrodes 11 are linear combinations of the row signals and the desired optical state of each pixel 14 in the column 18. Because the column signals during a frame period depend on the optical states of all pixels 14 in the column, the optical states of one pixel 14 can be affected by the optical states of other pixels 14 in the same column. The Active Addressing™ technique is, therefore, susceptible to crosstalk.

The different Walsh function addressing signals applied to different row electrodes 10 comprise different spectral voltage components. Therefore, unlike Alt and Pleshko addressing, the spectral voltage components of the pixel voltage depend upon the waveform of the row signals as well as the waveform of the column signals. This can result in a phenomena known as "row striping," in which some rows 16 appear lighter or darker than other rows 16 depending on the Active Addressing™ technique row function used to address the particular row 16. For example, the spectral components of Walsh functions increase in frequency as the sequency of the Walsh function increases, i.e., Walsh functions of low sequency have greater components at low frequencies than do Walsh functions of higher sequency. Therefore, rows 16 addressed by low sequency Walsh function signals appear brighter than rows 16 addressed by higher sequency Walsh function signals.

FIGS. 16*a*–16*d* are frequency domain plots showing respective spectral components 152, 154, 156, and 158 of applied pixel voltage waveforms for pixels 14 in a row 16 addressed by the 16th Walsh function 166 (FIG. 15*a*) of a set of 256 Walsh functions. Each of FIGS. 16*a*–16*d* represents a display system displaying a different one of four test images. FIGS. 17*a*–17*d* are frequency domain plots showing respective spectral components 178, 180, 182, and 184 of applied pixel voltage waveforms for pixels 14 in a row 16 addressed by the 232nd Walsh function 186 (FIG. 15*b*) of a set of 256 Walsh functions. Each of FIGS. 17*a*–17*d* represents a display system displaying the same test images as in respective FIGS. 16*a*–16*d*.

The difference between the spectral voltage components of the applied pixels waveforms for pixels 14 within the same row 16 of different test images, as illustrated by the differences among FIGS. 16*a*–16*d* or among FIGS. 17*a*–17*d*, is caused by differences in the image-dependent column-addressing signal. The difference between the spectral voltage components of the applied pixel waveforms for pixels 14 displaying the same image but addressed by different Walsh functions, as illustrated by comparing FIGS. 16*a* and 17*a*, 16*b* and 17*b*, 16*c* and 17*c*, or 16*d* and 17*d*, is caused by the different image-independent row-addressing signals. This latter difference of spectral components between rows 16 is not present in Alt and Pleshko addressing, which uses essentially the same addressing signal for each row.

Because of the frequency-dependent optical response, the difference between spectral components of applied pixel voltage waveforms for pixels in different images and for pixels in different rows of the same image results in pixels 14 in some rows 16 and columns 18 being lighter or darker than pixels in other rows 16 and columns 18, even though the pixels 14 in both rows or columns have the same rms voltage applied. These effects appear as column ghosting and row striping and degrade image quality.

The present invention greatly reduces these effects in systems using an Active Addressing™ technique in the same manner as described above for systems using an Alt and Pleshko addressing technique. The addressing signals are modified to compensate for the frequency-dependent optical response. In one embodiment the amplitude of the row signals are adjusted to compensate for frequency dependence of the optical response. The amplitude is reduced for row signals having significant low frequency components and increased for row signals having significant high frequency components.

In another embodiment of the invention, both the row- and column-addressing signals are modulated, thereby causing the spectral components of the pixel voltage waveform to appear primarily in the middle frequency band 54, in which the optical response is relatively independent of frequency, without changing the rms value of the pixel voltage waveform. A modulation circuit, similar to the one shown in FIG. 11, is typically used to modulate the Active Addressing™ technique signals.

FIGS. 18*a*–18*d* are frequency domain plots showing spectral components 178, 180, 182, and 184 of applied pixel voltage waveforms across pixels in row 16 addressed by the 16th Walsh function 166. The pixels 14 are in displays showing the same test images as the pixels of FIGS. 16*a*–16*d*, but the row- and column-addressing signals of FIGS. 18*a*–18*d* have been modulated by a Manchester signal as shown in FIG. 10.

Similarly, FIGS. 19*a*–19*d* are frequency domain plots showing respective spectral components 192, 194, 196, and 198 of the applied pixel voltage waveforms of pixels 14 in displays showing the same test images and addressed by the same Walsh function as pixels 14 of FIGS. 17*a*–17*d*, but the row- and column-addressing signals of FIGS. 19*a*–19*d* have been modulated by a Manchester signal as shown in FIG. 10.

FIGS. 18*a*–18*d* and 19*a*–19*d* show that the spectral components of the pixel voltage waveforms now appear predominantly in the middle frequency band 54. The optical response of pixels 14 is, therefore, substantially independent of the test image and the row address signal. The invention has, therefore, effectively reduced the crosstalk caused by the frequency-sensitive nature of display 2 by modifying the addressing signals to shift the spectral components of the applied pixel voltage waveforms to a frequency band in which the optical response is relatively independent of the frequency.

Figure 20A:
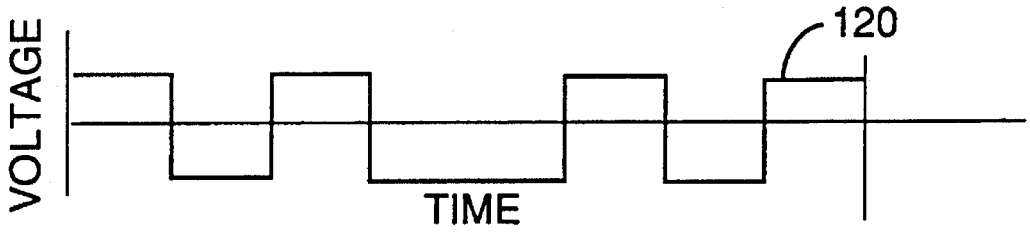
FIG. 20*a* is a graph showing the same part of a typical Active Addressing™ technique row signal as shown in FIG. 10*a*.
Figure 20B:
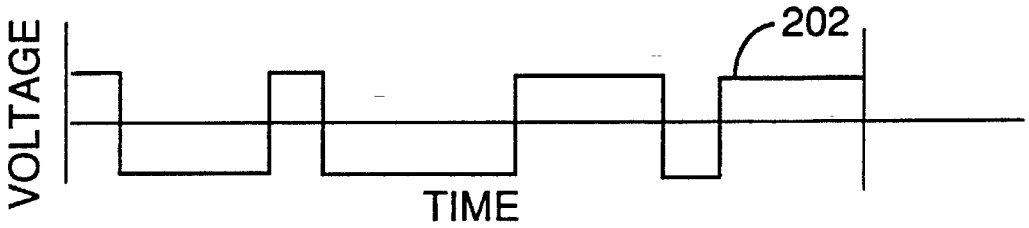
FIGS. 20*b* and 20*c* show the result of modulating the row signal of FIG. 20*a* during alternate addressing intervals, respectively.
Figure 20C:
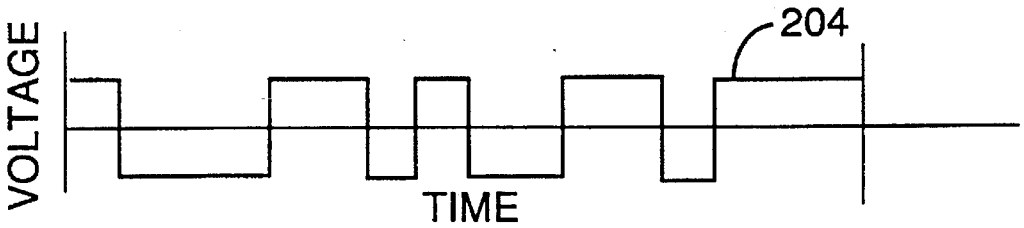
Figure 20D:
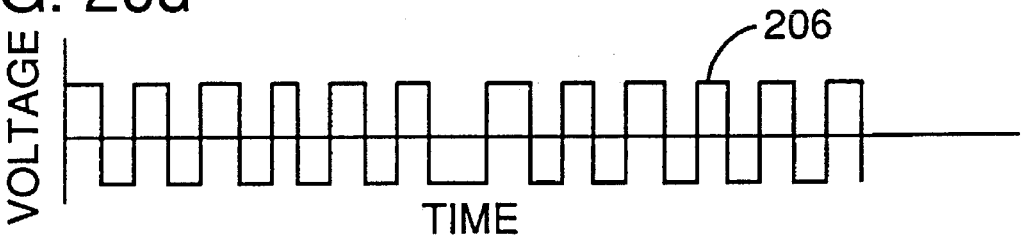
FIG. 20*d* shows the row signal of FIG. 20*a* modulated by a signal having a period of two-thirds of the addressing interval period.

It will be obvious to one skilled in the art that other types of modulation can be used to shift the applied voltage components into a band in which the optical response is insensitive to frequency. For example, it is possible to modulate the addressing signals less often than once in every addressing interval. FIG. 20*a* is a graph showing part of typical Active Addressing™ technique signal 120. FIGS. 20*b* and 20*c* show respective waveforms 202 and 204 that are the result of modulating row signal 120 on alternate addressing intervals, respectively, using a modulating waveform having a period equal to the addressing interval. FIG. 20*d* shows a waveform 206 that results from modulating row signal 120 of FIG. 20*a* using a modulating signal having a period of two-thirds of the addressing interval period.

Figure 21A:
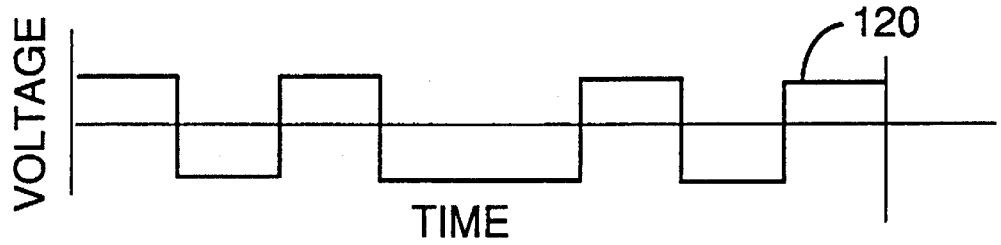
FIGS. 21*a*–21*e* are graphs showing another method of modulating addressing signals.
Figure 21B:
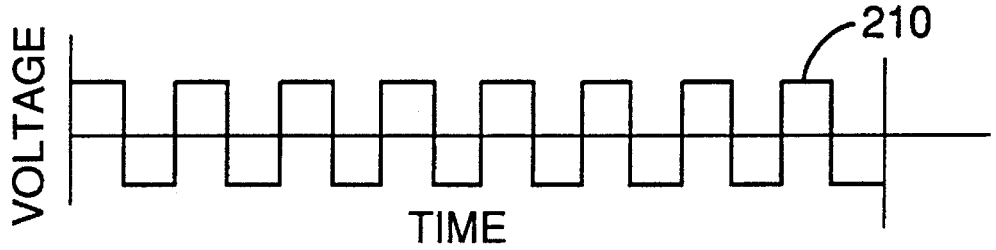
Figure 21C:
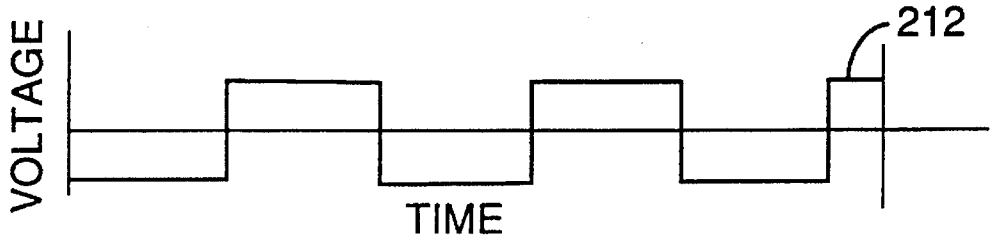
Figure 21D:
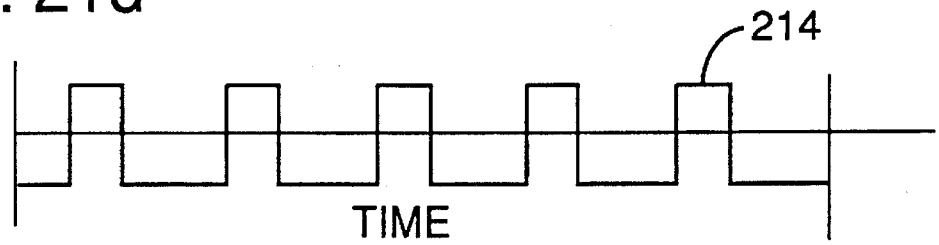
Figure 21E:
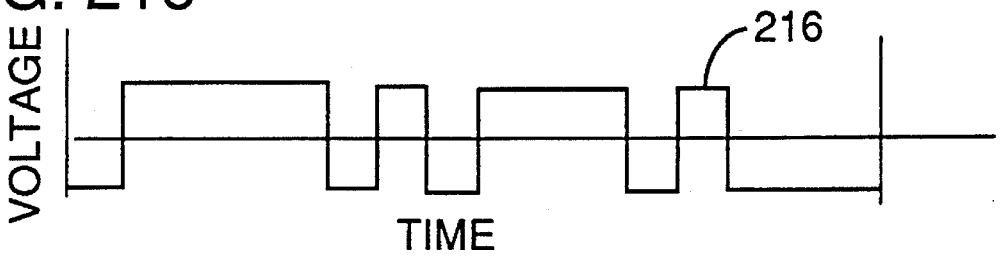

FIGS. 21*a*–21*e* show another method of modulating addressing signals. FIG. 21*a* is a graph of part of a typical Active Addressing™ technique row signal 120. FIG. 21*b* is a graph of a Manchester modulation signal 210 having a period equal to the addressing interval. FIG. 21*c* is a graph of a second modulation signal 212 having a period equal to three times the addressing interval. FIG. 21*d* is a graph showing a waveform 214 of a new modulation signal that results from modulating the waveform of modulation signal 212 with modulation signal 210. FIG. 21*e* is a graph showing a row signal waveform 216 that results from modulating row-addressing signal 120 with modulation signal 214.

Any modulation system that substantially shifts the frequency components of the pixel voltage into the middle frequency band can be used, although it is desirable to avoid higher frequency components that dissipate more power during display operation.

An adaptive embodiment typically entails first a determination of addressing signals that provide a pixel voltage averaged over a frame that is equal to the rms value that would produce a desired optical state if all frequency components fell in middle frequency band 54, i.e., if the optical response were not frequency dependent. These addressing signals are then analyzed into frequency components and adjusted to de-emphasize the effect of frequency components outside of middle frequency band 54. The effects of such frequency components are de-emphasized by decreasing the amplitude of the addressing signal, if low frequencies predominate, or increasing the amplitude of the addressing signals, if high frequencies predominate.

Figure 22:
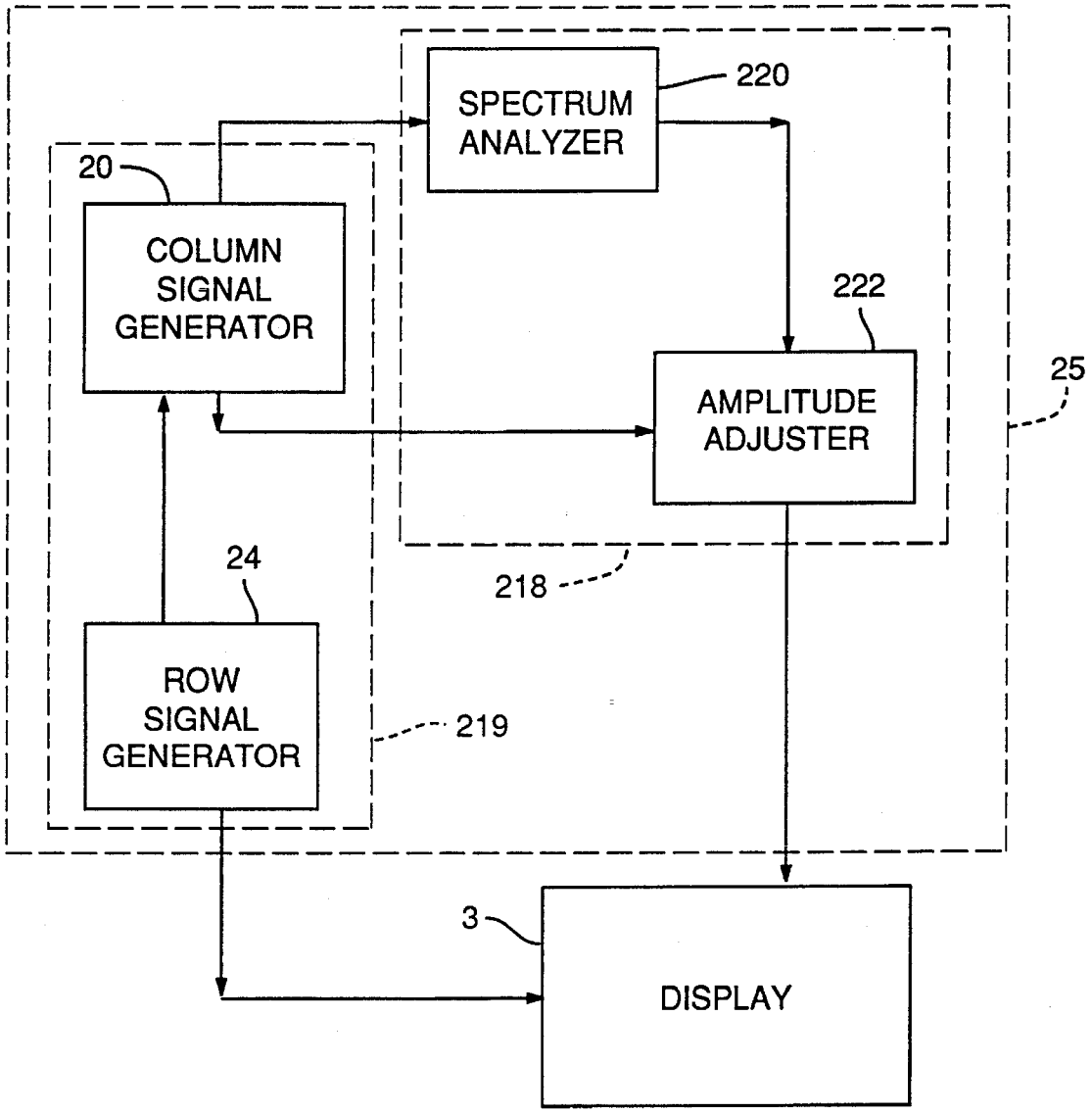
FIG. 22 is a block diagram showing an apparatus that utilizes an adaptive method of adjusting the amplitude of the addressing signal to compensate for the frequency sensitivity of the electro-optical material.

An adaptive embodiment of the present invention is shown schematically in FIG. 22. Row signal generator 24, column signal generator 20, and signal adjuster 218 together comprise an embodiment of an addressing signal generator 25. Row signal generator 24 and column signal generator 20 together comprise an addressing signal generator subunit 219 that produces addressing signals to produce a predetermined rms value across pixels 14 during a frame period. Column signal generator 20 determines the column voltage waveforms for a frame. Signal adjuster 218 comprises a spectrum analyzer 220 that analyzes the spectral components of the column voltage waveforms and an amplitude adjuster 222 that adjusts the amplitude of the column signals before they are applied to compensate for the frequency sensitivity of the optical response.

If spectrum analyzer 220 determines that the column voltage waveform includes significant high or low frequency components, amplitude adjuster 222 adjusts the column signals by increasing or decreasing the amplitude to de-emphasize the effect of the frequency components outside middle frequency band 54 so that pixels in the column having the same desired optical state will be equally bright. By adjusting the amplitude of the column signals, the rms voltage across all pixels 14 in the column are adjusted to compensate for the frequency sensitivity of display 3.

A complete frequency spectrum analysis of the pixel voltage during a frame can be performed by analyzer 220, for example, by a Fourier analysis of the frame before the addressing signals are applied. The amplitude of the column-addressing signals can then be modified in by amplitude adjuster 222 depending upon the frequencies of the pixel voltage components. A simpler approach would entail sampling the pixel voltage components at a few frequencies in block 220, for example at 100 Hz, 500 Hz, and 20 kHz. Although FIG. 22 shows signal adjuster 218 operating on the column signals, it could operate either column signals, row signals, or both. Also, the function of signal adjuster 218 could be combined into the row signal generator 24 or column signal generator 20 to generate directly addressing signal that de-emphasize components outside of middle frequency band 54.

Walsh functions are typically applied in sequency order. The part of the display using lower sequency functions, which have lower spectral voltage components, will appear brighter than parts addressed by higher sequency functions. This is corrected as described above by either modulating the addressing signals or adjusting the amplitude of the row signals to compensate for the frequency dependence of the optical response.

The frequency dependence of display 3 causes additional problems if display 2 uses intermediate gray levels. Intermediate gray levels within column 18 can result in a column signal having spectral components lying outside the middle frequency band of FIG. 1, thereby causing the pixel voltage waveforms to also lie outside this range, so pixels within the column 18 appear brighter or darker than desired. The deviation from the desired brightness generally increases as the number of pixels 14 at intermediate gray levels increases.

Figure 23:
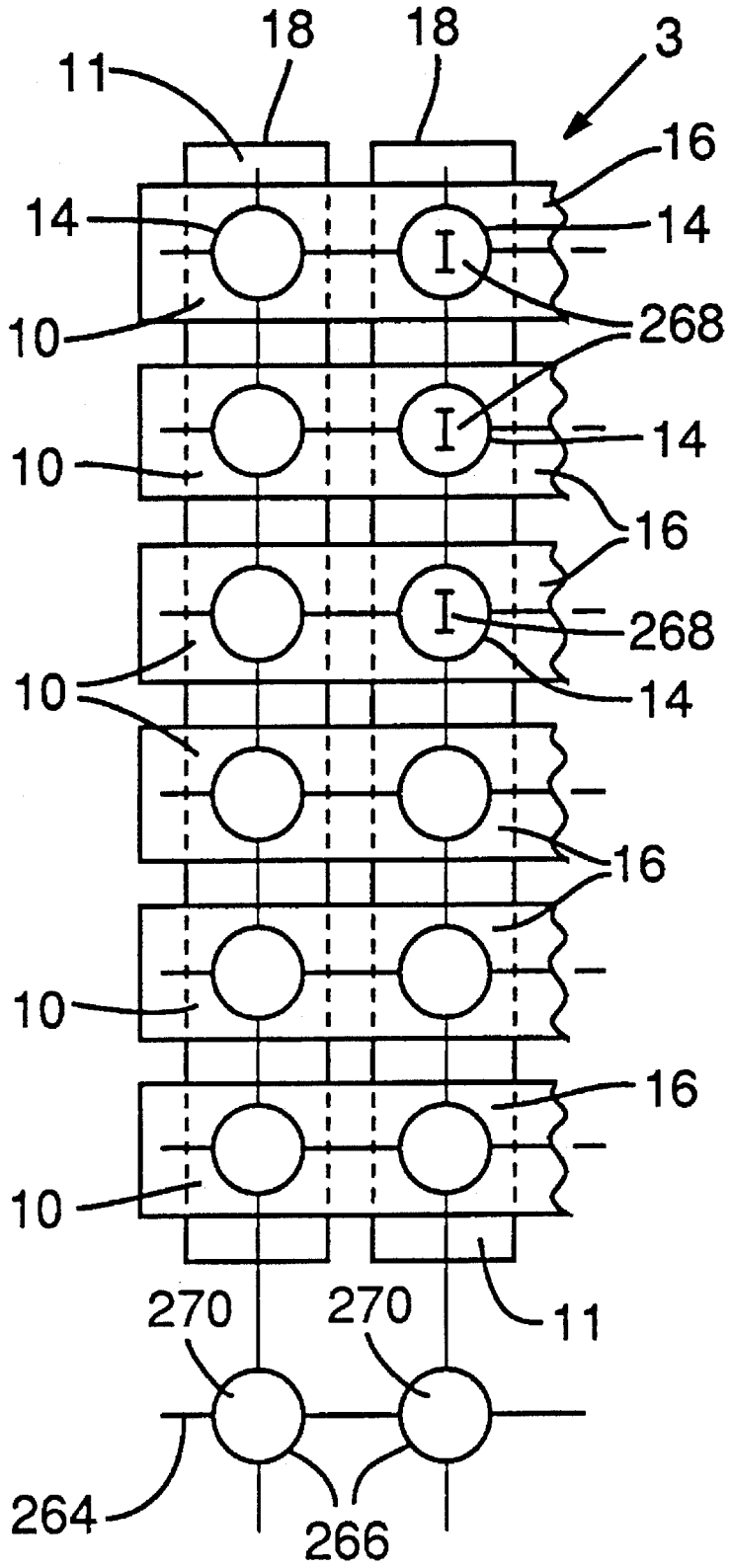
FIG. 23 is a diagrammatic plan view showing pixel information elements and virtual pixel information elements of the display in FIG. 2.

In a gray scale addressing method using virtual pixels, such as the full interval method described in copending U.S. patent application Ser. No. 07/883,002 for "Gray Level Addressing for LCDs," this crosstalk effect is eliminated by applying a correction factor to the information values of the virtual pixels. The method is described below with reference to FIG. 23. A virtual row 264 defines virtual pixels 266 by the overlap of column electrodes 11 and virtual row 264. With every real pixel 14, there is associated an information element 268 whose value, I, indicates the desired gray level of the pixel 14. The value of I varies between −1 for a dark pixel and +1 for a bright pixel. With every virtual pixel 266 there is associated a virtual information element 270 whose value, V, is determined by the values, I, of all the pixel information elements 268 in that column.

For the case of one virtual row 264, the value of the virtual information element, V, associated with each column 18, is determined from:

$$V=\pm\sqrt{N-\sum_{i=1}^{N} I_i^2}\ , \qquad \text{Eq. 1}$$

where N is the number of multiplexed rows 16 in display 2 and $I_i$ is the value of pixel information elements 268 in the ith row 16 of the column.

In Alt and Pleshko addressing using the virtual pixel gray level method, the column signal during any addressing interval is proportional to the value of the information element (I or Y) of the selected real row 16 or virtual row 264. More precisely, the column signal, G, for each column 18 during an addressing interval in which a real row 16 is selected is given by:

$$G=DI,$$

and during each addressing interval in which a virtual row 264 is selected by:

$$G=DV,$$

where "D" is the column voltage applied to a fully ON pixel 14. The addressing interval has a duration, Δt, that equals the frame period, T, divided by the sum of the number of real rows 16, N, and the number of virtual rows 264, n, thus, $\Delta t=T/(N+n)$.

In a system using an Active Addressing™ technique, the amplitude of the column signal during any addressing interval is proportional to the sum of the products of the real or virtual information elements, 268 or 270, and the corresponding row signal value for all real and virtual pixels, 14 and 266 in the column 11. For purposes of determining the column signals, virtual rows 264 are considered to be addressed by an appropriate active addressing function. The signal for each column 18 during any addressing interval, equals:

$$G=\frac{1}{\sqrt{N}}\sum_{i=1}^{N} I_iF_i+\frac{1}{\sqrt{N}}\sum_{k=N+1}^{N+n} V_kF_k$$

where $F_i$ is the amplitude of the row signal applied to that row 16 during the addressing interval, $V_k$ is the value of the ith virtual information element 270, calculated as described in Eq. 1, and $F_k$ is the amplitude of the row signal associated with that virtual row 264 during the addressing interval.

In this equation, the normalized, or rms values, of the row signals are equal to D. The first, or "dot product," term is the sum, taken over the N real rows 16, of the products of each information element value, I, in the column 18 and the voltage applied to the corresponding row. The second or "adjustment" term is the sum, taken over the n virtual rows 264, of the products of each virtual information elements value, V, in the column 18 and their corresponding virtual row voltages. The second term is added to the first in order to adjust the column signal to obtain the proper rms voltage across the pixels.

Because of spectral crosstalk, the frequency components of the virtual row signal affect the brightness of columns containing pixels at intermediate gray levels. The increased optical response of display 3 to low frequencies results in excessive brightness when the virtual row signal has a preponderance of low frequency components and the value of the virtual pixel information elements 270 are calculated as described above.

The present invention compensates for this increased brightness by applying a correction factor to the calculated value, $V_k$, of virtual information element 270 for each column 18. For example, an individual correction factor could be determined for each column 18, depending upon the gray levels of the pixels 14 in that column 18. A preferred correction method, however, is to multiply the calculated value of all virtual pixel information elements 270 by a single correction factor. In a typical display, in which the virtual row signal utilizes a row signal having significant low frequency components, a preferred correction factor is greater than 0.95 and less than 1.0, with 0.99 being most preferred. This single correction factor has been found empirically to approximately correct the brightness disparity for a display whose optical response is approximately that given in FIG. 1. In a display using a virtual row addressing waveform having significant high frequency components, a correction factor greater than one, typically between 1.0 and 1.1, would be used. The exact numerical value of the correction factor may also depend upon the design of the particular display 3. Applying the correction factor to the virtual pixel information value changes the amplitude of the frequency components contributed by the virtual row addressing signal, without significantly changing the amplitude of frequency components contributed by signals addressing the real rows.

In Alt and Pleshko addressing, modifying the value of virtual pixel information element 270 results in a change to the column signal only during the addressing interval in which the corresponding virtual row 264 is selected. In the Active Addressing™ technique, modifying the value of the virtual pixel information element 270 results in a change to the column signal during any addressing interval in which the value of the virtual row signal is not zero.

Figure 24:
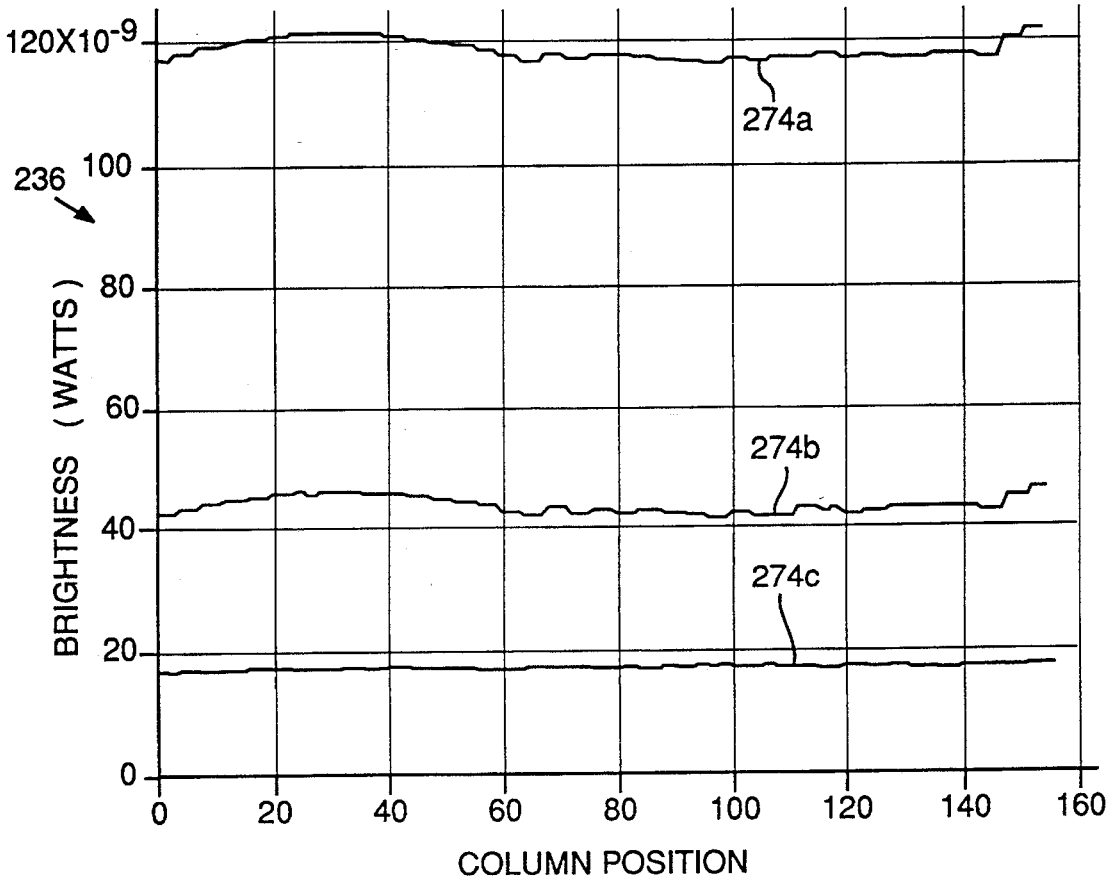
FIG. 24 is a graph of three curves, each of which represents the intensity of multiple pixels within a single row of a display that uses a correction factor applied to a virtual pixel value. Each curve represents pixels having a particular desired gray level.

FIG. 24 is a graph 236 showing three curves 274*a–c*, each curve showing the brightness of multiple pixels 14 within a group, each group comprising pixels in a single row 16. Pixels 14 within each group have the same desired gray level. The pixel groups whose brightnesses are shown in FIG. 24 are addressed using an Active Addressing™ technique with a single virtual row 264, and a correction factor of 0.99 is applied to the calculated value, $V_k$, of each virtual pixel information element 270. Because pixels 14 within each group 14*a–c* are in different columns 18 and the gray levels of the other pixels 14 in the different columns 18 are different, the actual brightness of the pixels 14 within each group 14*a–c* are not exactly the same. FIG. 24 shows that the brightness variation between columns 18 is relatively minor when the correction factor of the present invention is used.

It will be obvious that many changes may be made to the above-described details of the invention without departing from the underlying principles thereof. Any combination of adaptive and nonadaptive methods can be applied to the row electrodes, column electrodes, or both electrodes. The methods are equally applicable to displays with and without intermediate gray levels. Although the embodiments described use Alt and Pleshko addressing techniques, which selects each row once per frame, and Active Addressing™ technique, which select each row more than once per frame, the invention is applicable to any addressing method or system. For ease of understanding, the methods of the present invention are described above as calculating addressing signals to provide a predetermined rms voltage and then modifying those signals in accordance with the method of this invention. It is obvious that two separate steps are not required to produce addressing signals that reduce crosstalk in accordance with the present invention and that addressing signals that compensate for spectral crosstalk could be determined directly. The scope of the present invention should, therefore, be determined only by the following claims.

We claim:

1. A method of improving image quality in an rms-responding passive display that includes an array of pixels defined by the overlapping areas of first and second electrodes, each pixel having an optical state controlled by addressing signals having frequency components, the display having an optical response to the frequency components of the addressing signals, the optical response characterized by a relatively constant optical response frequency band and a relatively non-constant optical response frequency band, the method comprising:

determining addressing signals that select each pixel multiple times during a frame period and that provide the pixels with the desired optical state by de-emphasizing the effects of frequency components outside of the relatively constant optical response frequency band; and applying the addressing signals to the first and second electrodes, the addressing signals including image-independent addressing signals that are applied to the first electrodes and image-dependent addressing signals that are applied to the second electrodes, and the frequency components that fall outside of the constant optical response frequency band being de-emphasized by adjusting the magnitudes of components of the image-dependent addressing signals.

2. The method of claim 1 in which the determining of addressing signals includes determining addressing signal waveforms that provide a predetermined rms voltage across the pixels and are modulated so that the frequency components fall predominately in the constant optical response frequency band.

3. The method of claim 2 in which the addressing signal waveforms are applied during a frame period that includes multiple addressing time intervals and in which the addressing signals are modulated by reversing their polarities during a portion of an addressing time interval.

4. The method of claim 2 in which the addressing signals waveforms are modulated in accordance with a Manchester pulsed modulation signal.

5. The method of claim 2 in which the addressing signal waveforms are applied during a frame period that includes multiple addressing time intervals and in which the addressing signals are modulated by reversing their polarities less often than once in each addressing time interval.

6. The method of claim 1 in which the determining of addressing signals includes analyzing the frequency components of the addressing signals.

7. The method of claim 1 in which the magnitudes of fewer than all of the components are adjusted.

8. The method of claim 1 in which the display is capable of displaying more than two gray levels and the determining of the addressing signals applied to the second electrodes entails the process of computing an adjustment term determined from the gray level of pixels defined by the corresponding second electrodes, the adjustment term including a correction factor that compensates for the frequency dependence of the optical response of the display.

9. The method of claim 1 in which the display is capable of displaying more than two gray levels and a virtual first electrode defines a virtual pixel at its intersection with each of the second electrodes, each virtual pixel having an associated virtual pixel information element, the virtual pixel information elements having values dependent on the gray levels of the pixels defined by the corresponding second electrode and corrected by a factor depending upon the addressing signal associated with the virtual first electrode defining the virtual pixels.

10. The method of claim 9, in which the correction factor is greater than 0.95 and less than 1.0.

11. The method of claim 9, in which the correction factor is greater than 1.0 and less than 1.1.

12. The method of claim 1 in which image independent addressing signals are applied in sequency order to the first electrodes.

13. The method of claim 1, in which the pixels comprise a liquid crystal material.

14. A method of improving image quality in an rms-responding passive display that includes an array of pixels defined by the overlapping areas of first and second electrodes, each pixel having an optical state controlled by addressing signals having frequency components, the display having an optical response to the frequency components of the addressing signals, the optical response characterized by a relatively constant optical response frequency band and a relatively non-constant optical response frequency band, the method comprising:

determining addressing signal waveforms that select each pixel multiple times during a frame period and that provide the pixels with the desired optical state by providing a predetermined rms voltage related to the optical response of the pixels in the relatively constant optical response frequency band, the addressing signals being adjusted in magnitude to de-emphasize the effect of frequency components that fall outside of the constant optical response frequency band; and applying the addressing signals to the first and second electrodes.

15. An addressable rms-responding passive display, comprising:

first and second overlapping electrodes;

an array of pixels defined by overlapping areas of the first and second electrodes, each pixel having an optical state controlled by addressing signals having frequency components, the display having an optical response to the frequency components of the addressing signals, the optical response characterized by a relatively constant optical response frequency band and a relatively non-constant optical response frequency band; and an addressing signal generator for determining addressing signals that select each pixel multiple times during a frame period and that provide the pixels with the desired optical state, the addressing signal generator including means for adjusting the magnitudes of the addressing signals to de-emphasize the effects of frequency components outside of the relatively constant optical response frequency band.

16. The display of claim 15 in which the addressing signal generator further includes a modulator to modulate addressing signals so that spectral components of the addressing signals fall predominately in the constant optical response frequency band.

17. The display of claim 16 in which the modulator includes a Manchester circuit.

18. The display of claim 15 in which the addressing signal generator includes a spectrum analyzer for determining frequency components of the addressing signals.

19. The display of claim 15 in which:

the optical states of the pixels represent multiple gray levels; and the addressing signal generator generates image-dependent addressing signals by computing an adjustment term dependent upon the gray level of pixels defined by the corresponding second electrode, the adjustment term including a correction factor that compensates for the frequency dependence of the optical response of the display.

20. The display of claim 19 in which the addressing signal generator generates a virtual addressing signal for a virtual first electrode and the correction factor is related to the frequency components of the virtual addressing signal.

21. The display of claim 19 in which the correction factor is greater than 0.95 and less than 1.00.

22. The display of claim 19 in which the correction factor is greater than 1.0 and less than 1.1.

23. An apparatus for addressing a high information content, rms-responding passive display including an array of pixels, each pixel having an optical state controlled by a pixel voltage and being addressed by addressing signals having frequency components, the display having an optical response dependent on the frequency components of the addressing signals, the apparatus comprising:

an addressing signal generator subunit that provides addressing signals that select pixels more than once in a frame period to produce a predetermined rms value across the pixels during a frame period; and a signal adjuster that adjusts the magnitude of the addressing signals to compensate for the frequency dependence of the optical response of the display and thereby produce the desired optical response.

24. The apparatus of claim 23 in which the signal adjuster includes modulating the addressing signals to produce addressing signals having frequency component that fall in a relatively constant optical response frequency band.

25. The apparatus of claim 24 in which the compensation circuit includes a Manchester circuit.

* * * * *